US007112091B2

(12) United States Patent
Okura et al.

(10) Patent No.: US 7,112,091 B2
(45) Date of Patent: Sep. 26, 2006

(54) LOW-PROFILE CONNECTOR

(75) Inventors: Kenji Okura, Hisai (JP); Hirohisa Tanaka, Tsu (JP); Hidetoshi Takeyama, Hisai (JP); Hisanobu Tanaka, Kameyama (JP); Masato Shinotani, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/260,634

(22) Filed: Oct. 28, 2005

(65) Prior Publication Data

US 2006/0051988 A1 Mar. 9, 2006

Related U.S. Application Data

(62) Division of application No. 10/485,110, filed on Feb. 3, 2004, now Pat. No. 6,986,670.

(30) Foreign Application Priority Data

Jul. 23, 2002 (JP) ..... 2002-214319
Jul. 23, 2002 (JP) ..... 2002-214321

(51) Int. Cl.
*H01R 9/09* (2006.01)

(52) U.S. Cl. ..... 439/570

(58) Field of Classification Search ..... 439/570, 439/74

See application file for complete search history.

(56) References Cited

U.S. PATENT DOCUMENTS 5,120,256 A * 6/1992 Walden ..... 439/553
5,259,789 A 11/1993 Patel et al.
5,499,924 A 3/1996 Arisaka et al.
5,697,799 A * 12/1997 Consoli et al. ..... 439/181
5,836,773 A 11/1998 McHugh et al.
5,885,092 A 3/1999 Ito et al.
5,975,916 A 11/1999 Okura
6,254,429 B1 * 7/2001 Morita ..... 439/570
6,338,630 B1 1/2002 Dong
6,394,841 B1 * 5/2002 Matsuura ..... 439/607
6,623,308 B1 9/2003 Ono
6,645,005 B1 * 11/2003 Wu ..... 439/563
6,699,069 B1 * 3/2004 Inoue ..... 439/570
6,821,158 B1 11/2004 Iida et al.

FOREIGN PATENT DOCUMENTS

EP 0800241 10/1997
EP 0991141 4/2000
EP 1198031 4/2002

* cited by examiner

*Primary Examiner*—Neil Abrams
(74) *Attorney, Agent, or Firm*—Greenblum & Bernstein, P.L.C.

(57) ABSTRACT

A low-profile connector for connecting two circuit boards of a-mobile equipment is constituted by a header and a socket. The header comprises a resin molded header body and a plurality of pairs of posts (conductive terminals) provided on the header body. The socket comprises a resin molded socket body and a plurality of sets of contacts provided on the socket body corresponding to the posts of the header. The header body and the socket body respectively have reinforcing member made of metal thin plate for reinforcing the header and the socket with respect to contortion or crack. Top end of the post is rolled to be reverse U-shape for contacting with the contact at two portions, in which a first contact portion is formed a part of a fitting portion of the contact at which the contact is held on the socket body and a second contact portion is a top end of a plate spring portion of the contact incurred for facing the first contact portion.

6 Claims, 26 Drawing Sheets

LOW-PROFILE CONNECTOR

CROSS-REFERENCE TO RELATED APPLIACTION

This application is a divisional application of U.S. patent application Ser. No. 10/485,110, now U.S. Pat. No. 6,986, 670, which is hereby incorporated by reference, in its entirety, into the present application.

BACKGROUND AND FILED OF THE INVENTION

1. Technical Field

The present invention relates to a low-profile connector comprising a header and a socket which are respectively mounted on circuit boards.

2. Background Art

In recent years, a low-profile connector is practically used for connecting electric circuits formed on two circuit boards (including flexible printed circuit board) in a manner so that the circuit boards face each other. In mobile equipment such as a mobile phone, the connector is required to be downsized and to have a low profile corresponding to the miniaturization and the low profile of the mobile equipment. On the other hand, a packaging density of the electronic components mounted on the circuit board becomes higher due to high functionality of the mobile equipment, so that number of arrangement of contacts constituting the connector is tend to be increased and the width and pitch of arrangement of the contacts become much narrower. Especially in a flip phone, the circuit boards, on which the electronic components are mounted are separately disposed on both sides with respect to a hinge, and flexible substrates provided in the inside of the hinge are used for connecting the separated circuit boards. Thus, the application of the connector will be expanded for connecting the circuit boards each other or connecting the electronic components and the circuit boards.

The connector for connecting two circuit boards is constituted by a header corresponding to a male connector mounted on one circuit board and a socket corresponding to a female connector mounted on the other circuit board.

FIG. 29 shows sectional views of a socket 201 and a header 210 of a conventional connector. The socket 201 comprises a socket body 202 and a plurality of pairs of contacts 204. The socket body 202 is made of resin molding and has a pair of elongate recesses 203 formed along both sidewalls 202*a* of the socket body 202 and a center table portion 215. A plurality of fitting grooves 202*b* are formed at a predetermined pitch on both sidewalls 202*a* of the socket body 202 in a direction perpendicular to the paper sheet of FIG. 29. Each contact 204 is made of a conductive metal thin plate so as to have a U-shaped plate spring portion 205, a reverse U-shaped fitting portion 206 and a soldering terminal 207, which are integrally formed. Each fitting portion 206 of the contact 204 is press-fitted into the fitting groove 202*b* on the sidewall 202*a* so as to grip the sidewall 202*a*. The soldering terminal 207, which is to be soldered on a circuit board, is formed by bending a rear end portion of the contact 204 toward the outside from a rear end of the fitting portion 206. The plate spring portion 205 is formed to have a U-shape by bending a front end portion of the contact 204 from a front end of the fitting portion 206, so that the plate spring portion 205 is disposed in the recess 203 so as to be warped freely. A front end of the plate spring portion 205 is doglegged so as to form a contacting portion 209.

The header 210 comprises a header body 211 and a plurality of pairs of posts 212. The header body 211 is made of resin molding and has a groove 211*a* which engages with the table portion 215 of the socket body 202 of the socket 201. The post 212 is made of a conductive metal thin plate by bending substantially reverse L-shape. A rear portion of the post 212 protruding toward the outside serves as a soldering terminal 214 which is to be soldered on a circuit board. Each post 212 is fixed on the header body 211, since a base of the post 212 is inserted into the header body 211 while the header body 211 is molded in a manner so that the pairs of posts 212 are arranged at the predetermined pitch in the direction perpendicular to the paper sheet of FIG. 29.

FIG. 30 shows a state that the socket 201 and the header 210 are coupled with each other. For coupling the socket 201 with the header 210, the table portion 215 of the socket body 202 of the socket 201 is fitted into the groove 211*a* of the header body 211 of the header 210. At that time, a curved lower end 212*a* of the post 212 of the header 210 contacts a slanted face at an upper end of the plate spring portion 205 of the contact 204, so that the plate spring portion 204*a* of the contact 204 is warped inwardly. Subsequently, the post 212 and a sidewall of the header body 211 of the header 210 are disposed between a side face of the table portion 215 and the contact 204 of the socket 201. Thus, the contacting portion 209 of the contact 204 elastically contacts with a side face of the post 212.

In such the connector, it is required to making the mounting areas of the socket and the header much narrower corresponding to the downsizing of the mobile equipment. Furthermore, it is required to provide a low-profile connector corresponding to the low profile of the mobile equipment using the circuit boards. Actually, a connecter having a pitch 0.3 to 0.5 mm of arrangement of the contacts of the socket and the posts of the header is supplied. Furthermore, a low-profile connector having a thickness called stacking height less than 1.5 mm (for example, 1.2 mm or 1.0 mm) when the header is coupled with the socket is also provided.

It is further required to make the pitch of the contacts much narrower and to make the stacking height of the connector much lower. Concretely, it is required to make the stacking height of the connector less than 1.0 mm. When the stacking height between a lower face of the soldering terminal 207 of the contact 204 of the socket 201 and an upper face the soldering terminal 214 of the post 212 of the header 210 in the above-mentioned conventional connector is made much thinner in a range between 0.9 mm to 0.8 mm, there is a limit to lengthen the length of the plate spring portion 205 of the contact 204, so that the spring characteristics of the plate spring portion 205 of the contact 204 cannot be increased. Thus, a sufficient contact pressure cannot be obtained between the plate spring portion 205 of the contact 204 and the post 212. Furthermore, when a dimension "C" between a peak of the contact portion 209 and a base of a side 206*a* of the fitting portion 206 of the contact 204 is made larger than a dimension "D" between the base of the side 206*a* and a base of the plate spring portion 205, the stress concentration occurs at the bent corner of the U-shaped plate spring portion 205 when the plate spring portion 205 is warped. Still furthermore, the shear plane at top end of the contact 204 is caught on the header 210 when the header 210 is coupled with the socket 201, so that the contact 204 may be deformed.

Still furthermore, when the stacking height of the connector is made thinner, it is necessary to make the socket body 202 of the socket 201 and the header body 211 of the header 210 thinner. Thus, there is a possibility that the thickness of the sidewalls and bottom wall of the bodies 202 and 211 become too thin to maintain a practical strength. In other words, contortion and/or crack can easily occur in the socket body 202 of the socket 201 and the header body 211 of the header 210 due to the stress generated in the socket 201 and the header 210 while the socket 201 and the header 210 are treated or mounted on the circuit boards.

DISCLOSURE OF INVENTION

An object of the present invention is to provide a low-profile connector having high reliability of connection even when the stacking height is made lower. Another object of the present invention is to provide a low-profile connector having a sufficient strength with respect to the contortion and the crack.

A low-profile connector in accordance with an aspect of the present invention is constituted by a header and a socket, which are respectively mounted on circuit boards for connecting electric circuit formed on the circuit boards. The header comprises a header body made of resin molding, and a plurality of posts made of a conductive metal thin plate and provided at a predetermined pitch on a peripheral wall of the header body. The socket comprises a socket body made of resin molding and a plurality of contacts made of a conductive metal thin plate and provide at the predetermined pitch in a guide grooves on a peripheral wall of the socket body, which are to be contacted with the posts provided on the header.

Each post is inserted into the header body and comprises a first contact portion appeared on an outer face of the peripheral wall of the header body, a second contact portion appeared on an inner face of the peripheral wall, a ceil portion formed between the first contact portion and the second contact portion and overstriding the peripheral wall, and a soldering terminal formed on an end of the second contact portion by bending substantially at right angle, at which the post is soldered on a circuit pattern of a circuit board.

Each contact comprises a plate spring portion, a fitting portion at which the contact is held on the socket body and a terminal portion to be soldered on a circuit pattern on a circuit board, which are integrally formed from a front end to a rear end of the contact. The fitting portion has a first contact portion disposed along an inner face of a peripheral wall of the socket body and to be contacted with the first contact portion of the post of the header, and a ceil portion overstriding the peripheral wall and an arm portion substantially parallel to the first contact portion. The plate spring portion has a lateral portion, a first slanted portion, a curved portion, a second slanted portion, and a doglegged second contact portion to be contacted with the second contact portion of the post of the header. The lateral portion is formed by bending substantially at right angle for protruding inwardly from a lower end of the first contact portion of the fitting portion. The first slanted portion is formed by bending at a predetermined angle with respect to the lateral portion from a top end thereof; the curved portion is formed by bending from the top end of the first slanted portion so as to be turned back substantially in the opposite direction; the second slanted portion is formed as an elongation of the fourth curved portion; and the second contact portion is formed for incurving an elongation of the second slanted portion.

By such a configuration, since no shear plane is appeared on the surface of contact portions of the post, the contact may not be deformed due to the contact be caught on the post when the header is coupled with the socket. Furthermore, since the plate spring portion of the contact can have a sufficient length for generating a necessary contact pressure, not only the electric connection between the post of the header and the contact of the socket can be much more reliable, but also the stress in the plate spring portion can be reduced. As a result, the life of the contact can be extended. Still furthermore, since the post and the contact are contacted at two points, the plate spring portion of the contact can be made tough with respect to undesirable force when the header is coupled with the socket.

A low-profile connector in accordance with another aspect of the present invention constituted by a header and a socket, which are respectively mounted on circuit boards for connecting electric circuit formed on the circuit boards. The header comprises a header body made of resin molding, and a plurality of posts provided at a predetermined pitch on a peripheral wall of the header body. The socket comprises a socket body made of resin molding and a plurality of contacts provide at the predetermined pitch on a peripheral wall of the socket body, which are to be contacted with the posts provided on the header. At least one of the header and the socket further comprises at least a reinforcing member provided in a portion of a peripheral wall of the header body and the socket body where the posts and the contacts are not provided.

By such a configuration, since the reinforcing member is provided in the header body and/or the socket body at a portion where no post and/or no contact is provided, the mechanical strength of the header body and/or the socket body with respect to external force can be increased. As a result, possibility of occurrence of contortion and/or crack becomes much smaller than that of the conventional connector.

BEST MODE FOR CARRYING OUT THE INVENTION

Figure 1:
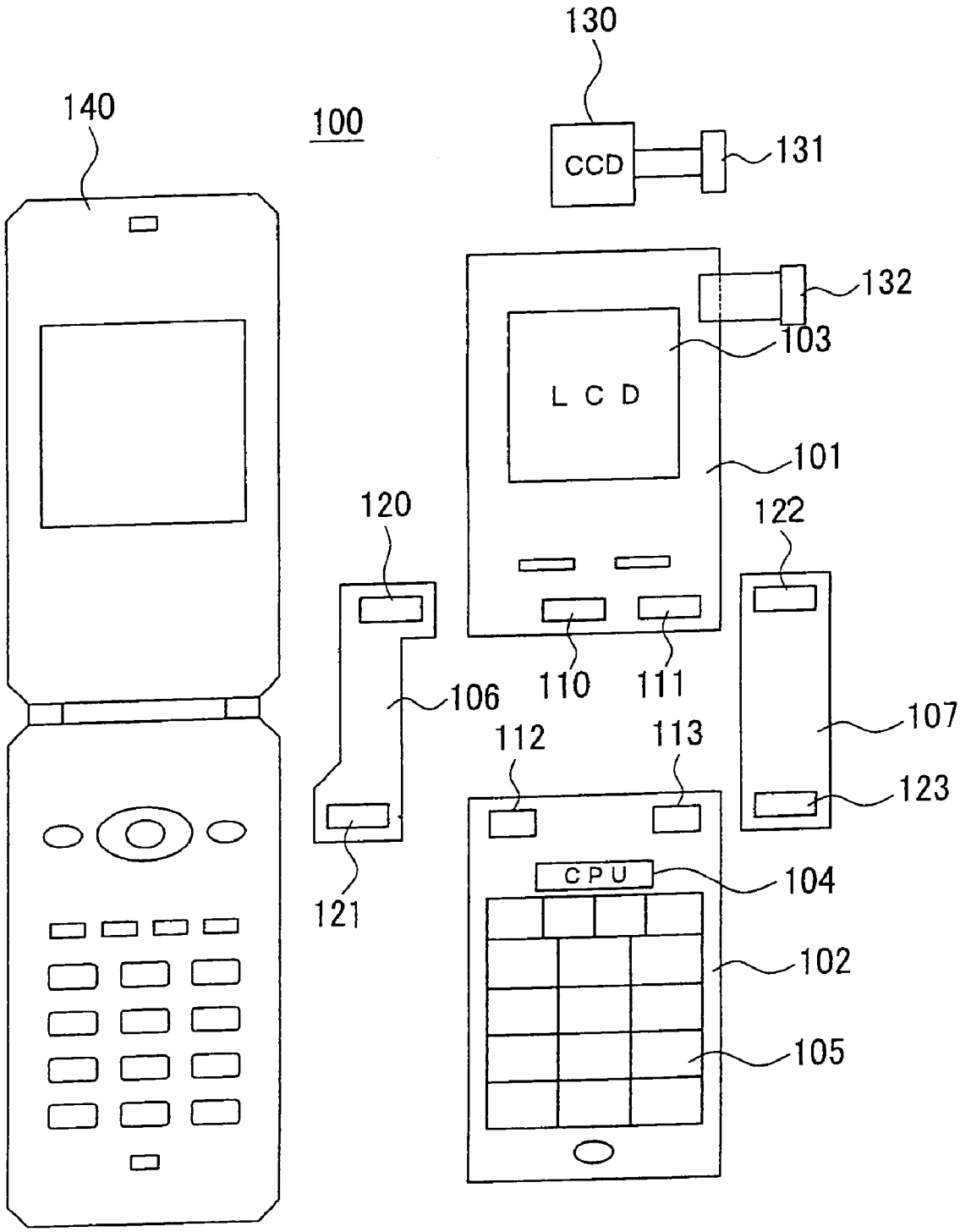
FIG. 1 is an exploded view showing a configuration of a flip phone, which is an example of a use of a low-profile connector in accordance with the present invention.

An embodiment of the present invention is described with reference to the drawings. FIG. 1 shows electric connections among circuit boards and electronic components in a flip phone, which is an example of the use of a low-profile connector in the embodiment of the present invention.

As can be seen from FIG. 1, the circuit boards of the flip phone 100 is separated into a first circuit board 101 on which an LCD 103 and so on are mounted and a second circuit board 102 on which a CPU 104, switch plate 105 and so on are mounted. Flexible substrates 106 and 107 connect between the first circuit board 101 and the second circuit board 102. Connectors 110, 111, 112 and 113 are respectively mounted on the first circuit board 101 and the second circuit board 102. Other connectors 120, 121, 122 and 123 are mounted on the flexible substrates 106 and 107 corresponding to the connectors 110 to 113. The first circuit board 101 is electrically connected to the second circuit board 102 via the connectors 110 to 113 and 120 to 123 and the flexible substrates 106 and 107. Similarly, the electronic component such as a CCD camera 130 is connected to the first circuit board 101 via connectors 131 and 132. In FIG. 1, numeral 140 designates a housing of the flip phone 100.

Figure 2:
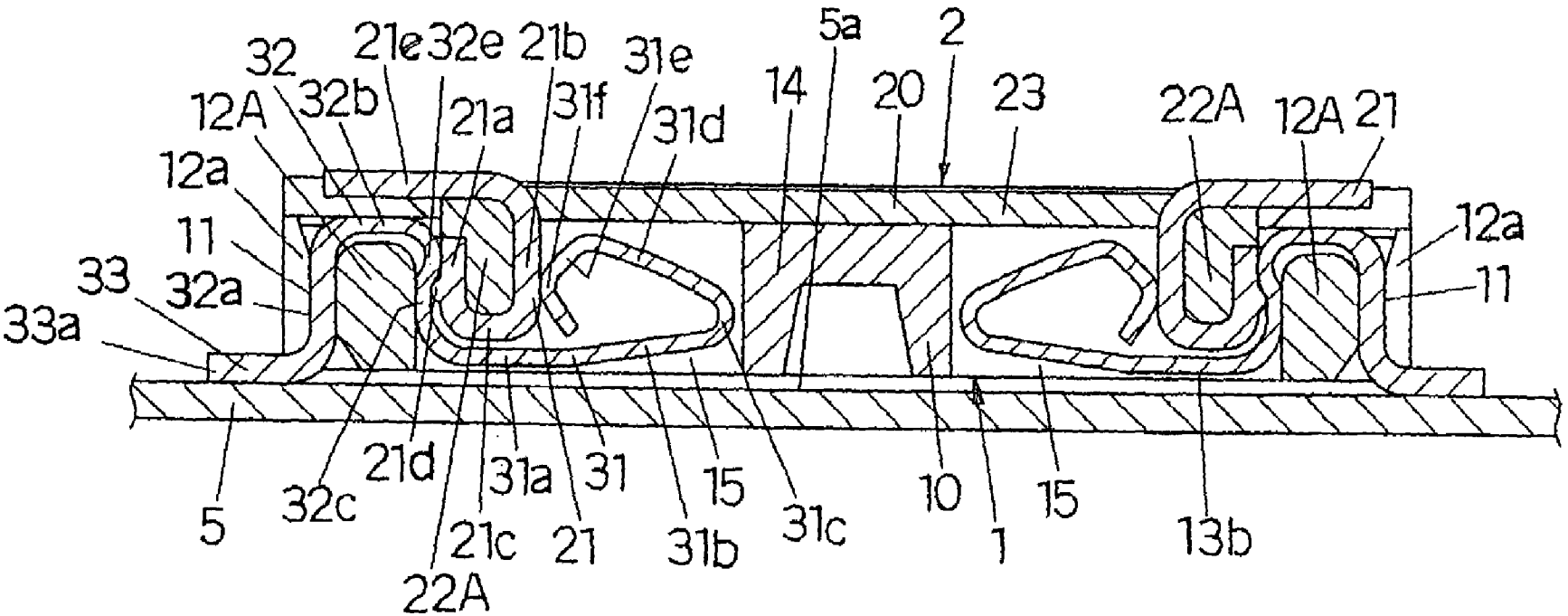
FIG. 2 is a cross sectional view showing a state that a header and a socket constituting a connector in accordance with an embodiment of the present invention are coupled.

FIG. 2 shows a state that a socket 1 and a header 2, which constitute the low-profile connector of this embodiment, are coupled. The connector is required not only electrically to connect a plurality of pairs of contacts held on the socket 1 to a plurality of pairs of posts held on the header 2 but also to maintain the connection of the contacts and the posts. The connector is constituted of the header 2 and the socket 1. In FIG. 2, the socket 1 is illustrated below the header 2. The relation of above and below between the socket 1 and the header 2 is not restricted by the illustration.

Figure 3:
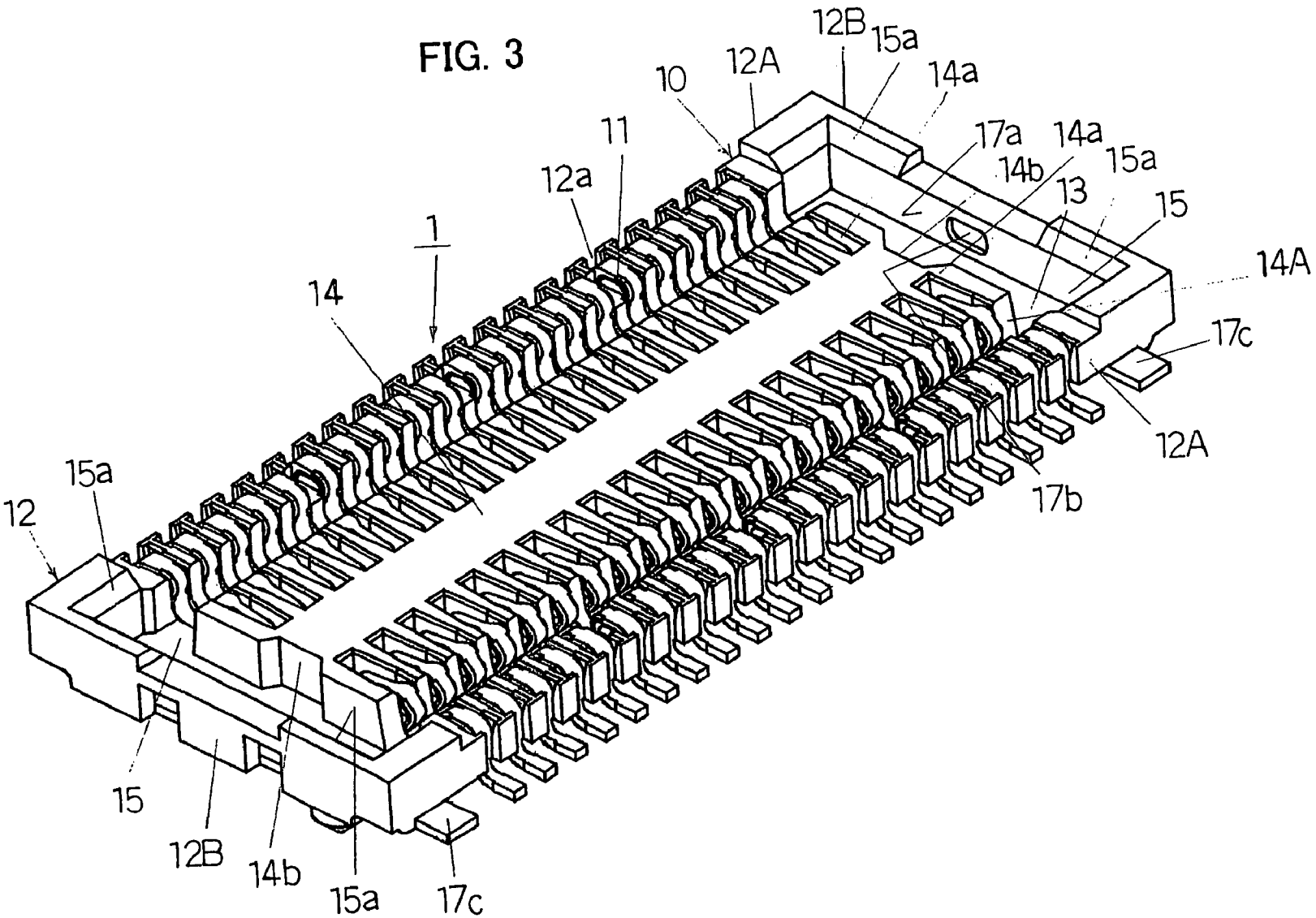
FIG. 3 is a perspective top view showing a configuration of the socket.
Figure 4:
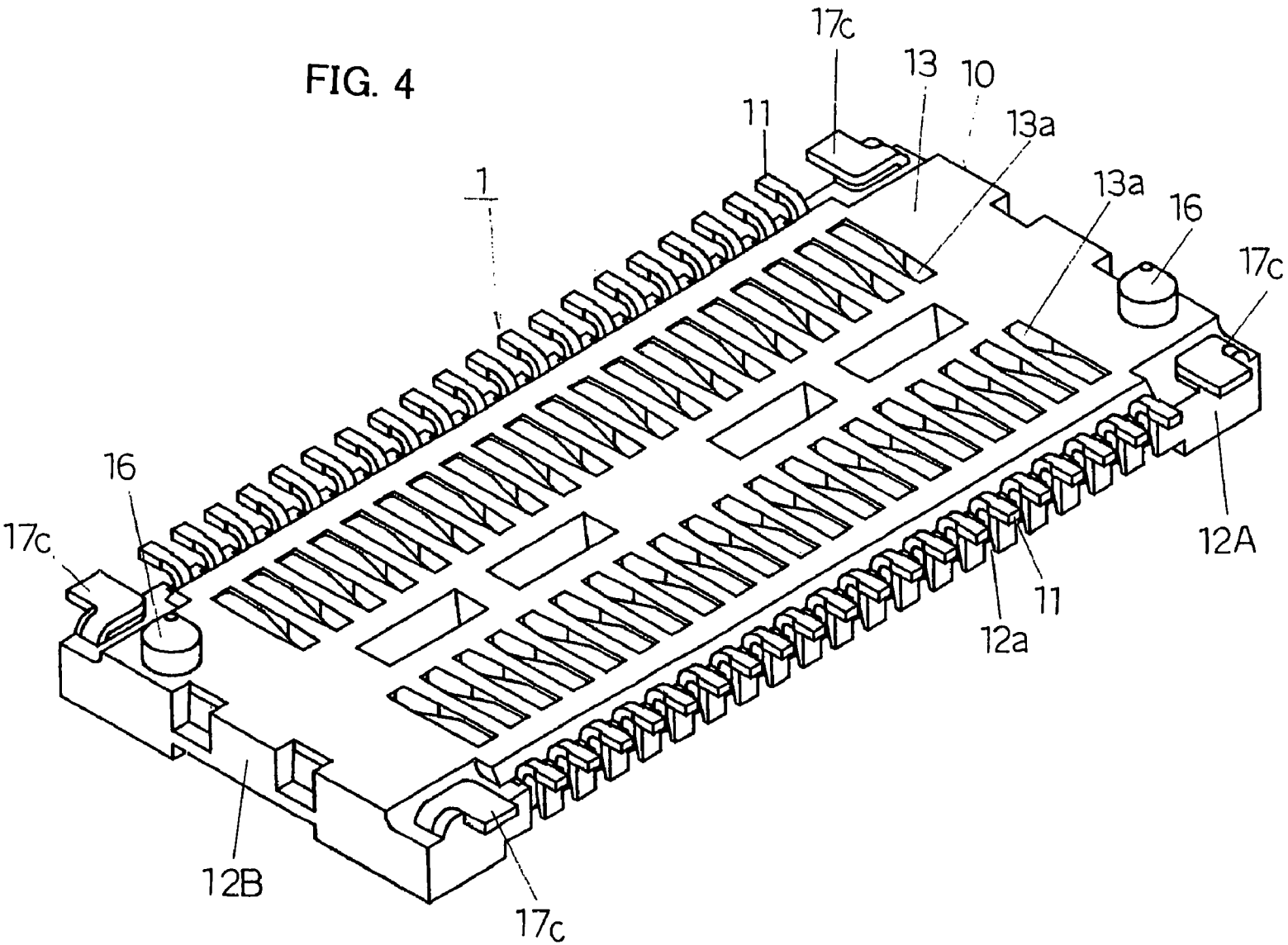
FIG. 4 is a perspective bottom view of the socket.
Figure 5:
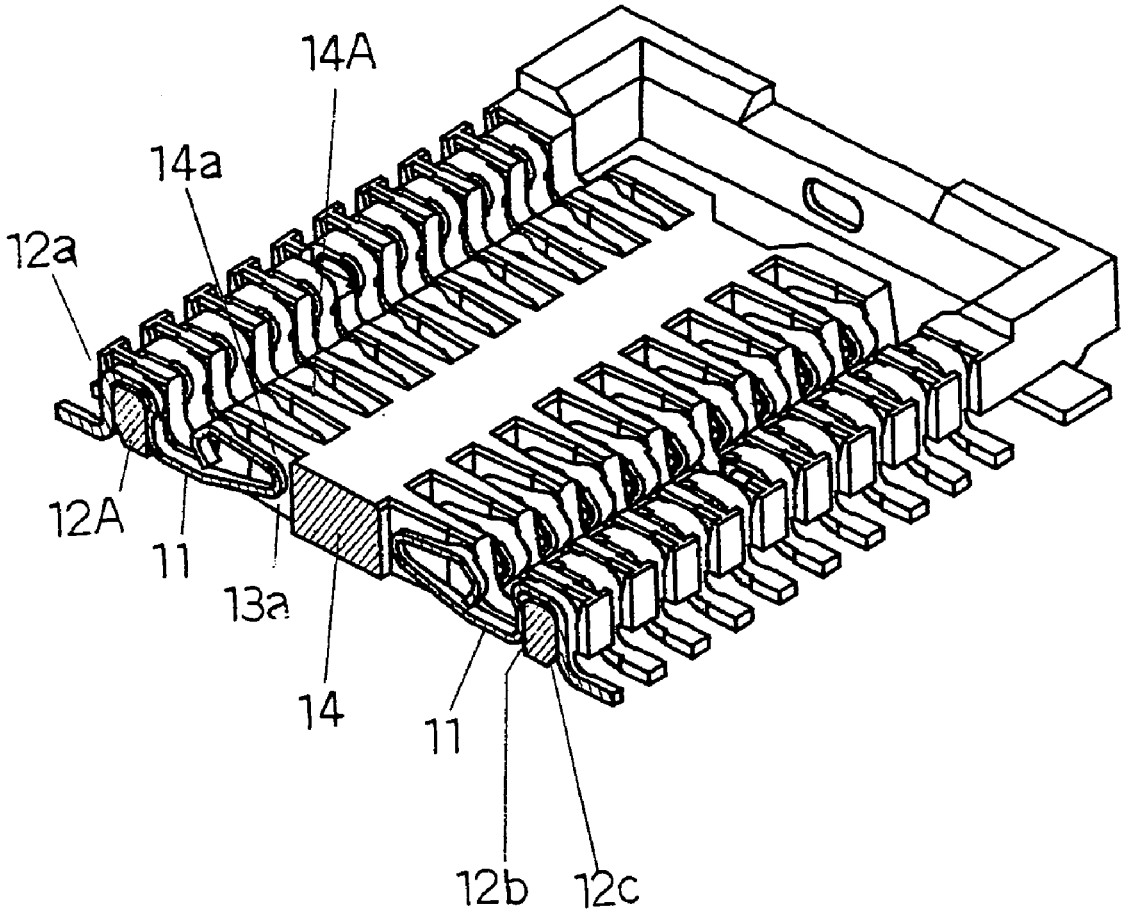
FIG. 5 is a sectional perspective top view of the socket.

Details of the socket 1 are described with reference to FIGS. 3 to 5. FIG. 3 is a perspective top view of the socket 1. FIG. 4 is a perspective bottom view of the socket 1. FIG. 5 is a sectional perspective top view of the socket 1.

As can be seen from FIGS. 3 to 5, the socket 1 comprises a socket body 10 having a rectangular parallelepiped shape and made of an insulation resin molding. The socket body 10 has a peripheral wall 12 squarely enclosing an inner space of the socket body 10. A plurality of pairs of contacts 11 is arranged along two elongate side portions 12A of the peripheral wall 12. The socket body 10 further has a rectangular table portion 14, which is protruded from a bottom wall 13 of the socket body 10. Accordingly, a coupling recess 15 is squarely formed between the peripheral wall 12 and the table portion 14. The coupling recess 15 is formed symmetrical with respect to center axes in the longitudinal direction and the widthwise direction of the socket body 10. Chamfers 15*a* are formed at upper inside edges of four corners of the peripheral wall 12. A plurality of pairs of fitting grooves 12*a*, into which the contacts 11 are press fitted, is formed corresponding to the arrangement of the contacts 11 on both elongate side portions 12A of the peripheral wall 12 so as to overstride from the inner face 12*b* facing the coupling recess 15 to the outer face 12*c* (see FIG. 5).

A plurality of pairs of through holes 13*a* is formed corresponding to the arrangement of the contacts 11 on the bottom wall 13 (see FIG. 4). Correspondingly to the through holes 13*a*, a plurality of pairs of guide grooves 14*a* communicating to the through holes 13*a* are formed on the elongate sides 14A of the table portion 14 separately for guiding the contacts 11. A pair of mounting legs 16 is formed for protruding outwardly at positions on an outer face of the bottom wall 13 in the vicinity of two corners symmetrical with respect to the center of the socket body 10 (see FIG. 4). The mounting legs 16 will be fitted into positioning holes provided on a circuit board (not shown), so that the socket 1 can be positioned on the circuit board. Top ends of the mounting legs 16 are tapered, so that it can be inserted into the positioning holes, easily. Furthermore, a pair of recesses 14*b* is formed on both ends of the table portion 14 in the longitudinal direction of the socket body 10. Use of the recesses 14*b* will be described below.

Figure 6:
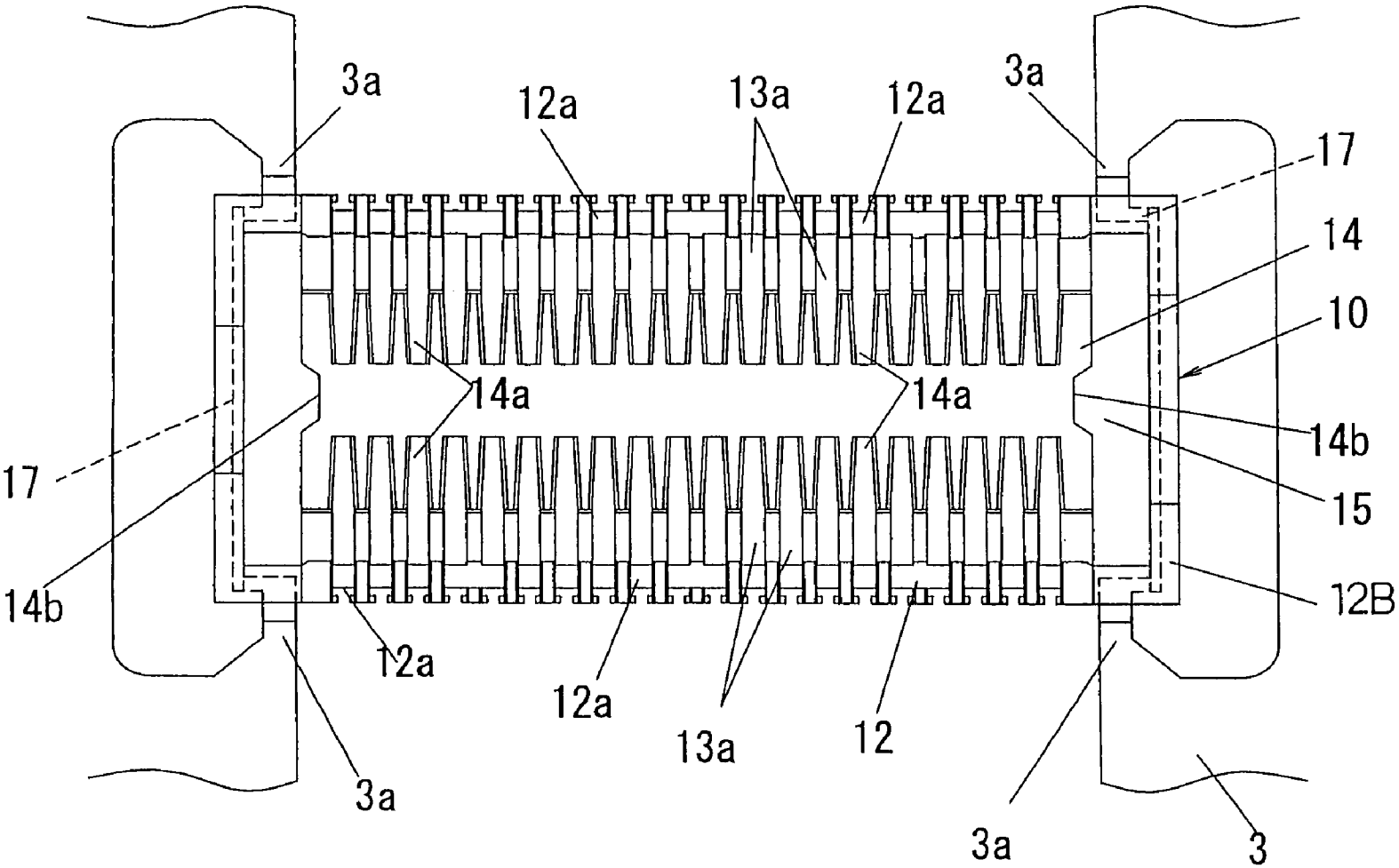
FIG. 6 is a plan view showing a blank of a socket body of the socket just after resin molding process.
Figure 7:
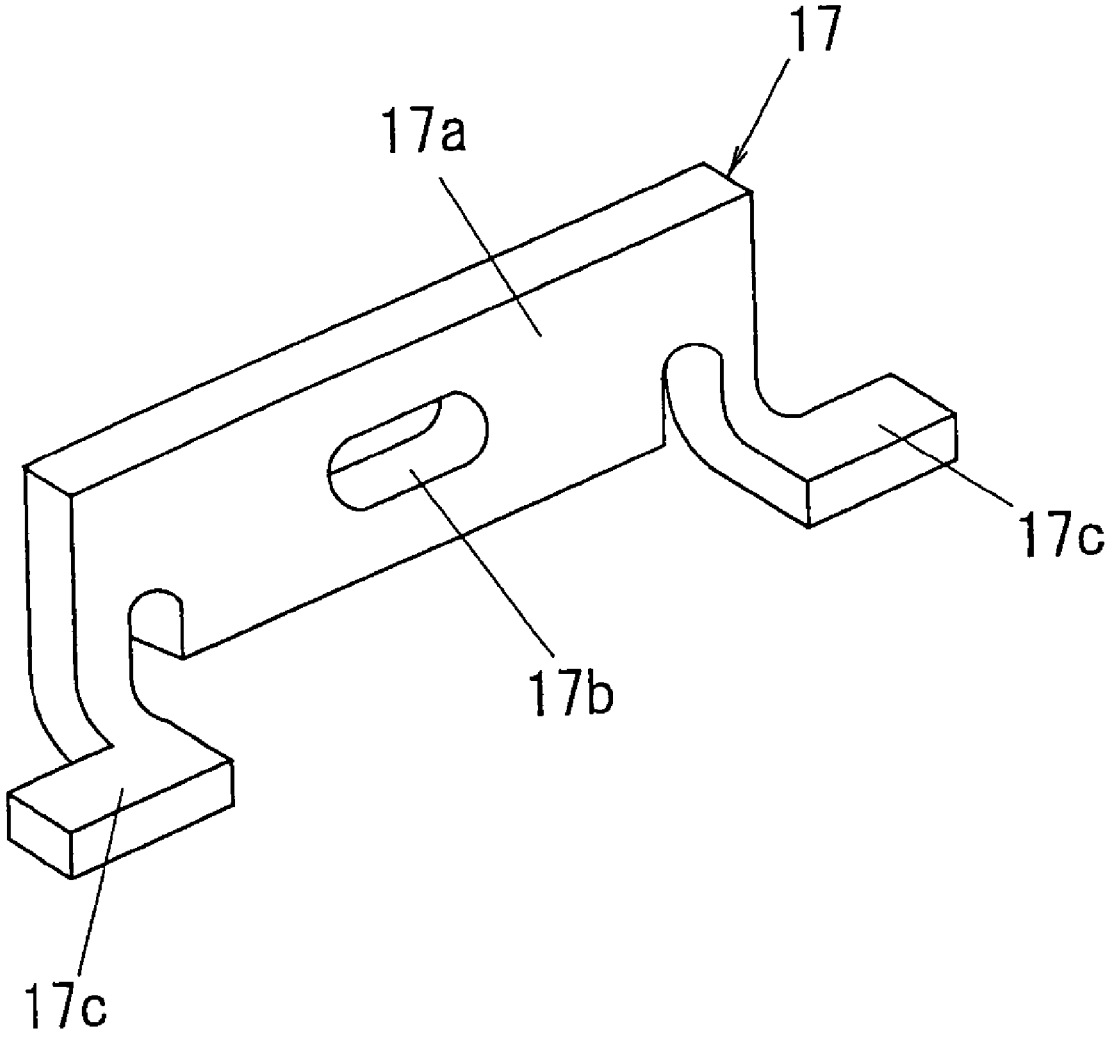
FIG. 7 is a perspective view showing a configuration of a socket reinforcing plate inserted in the socket.
Figure 8A:
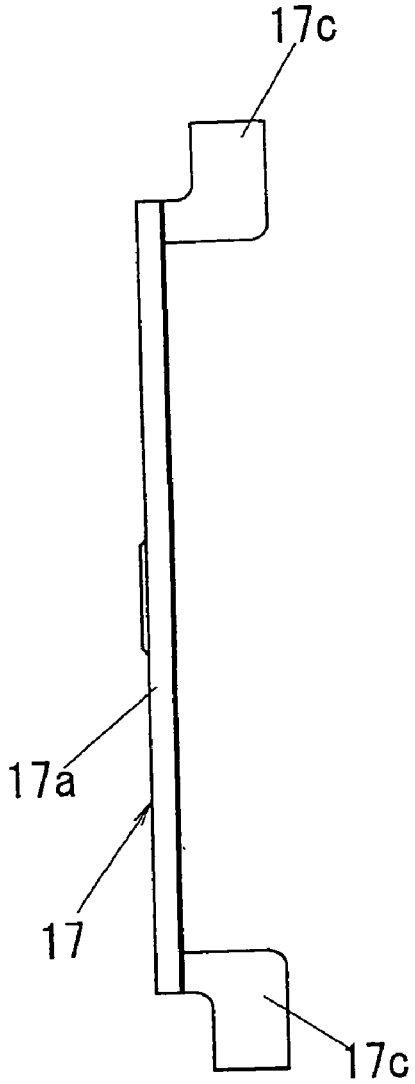
FIG. 8A is a plan view of the socket reinforcing plate.
Figure 8B:
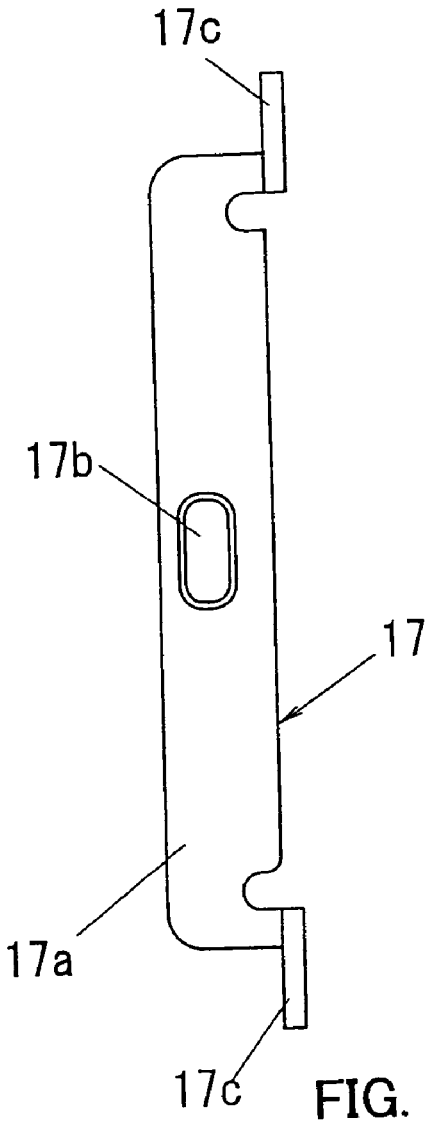
FIG. 8B is a front view of the socket reinforcing plate.
Figure 8C:
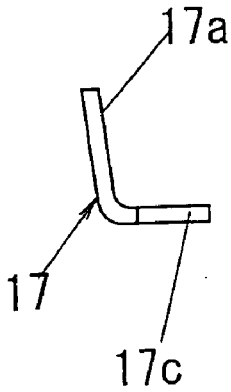
FIG. 8C is a side view of the socket reinforcing plate.
Figure 8D:
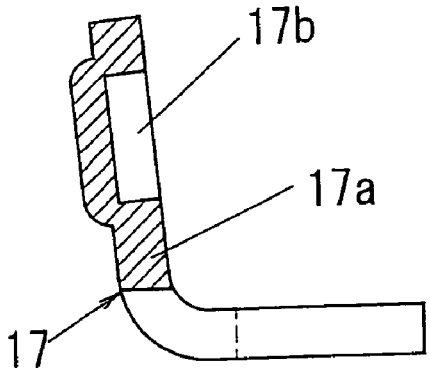
FIG. 8D is an enlarged sectional side view showing details of a main portion of the socket reinforcing plate.
Figure 9:
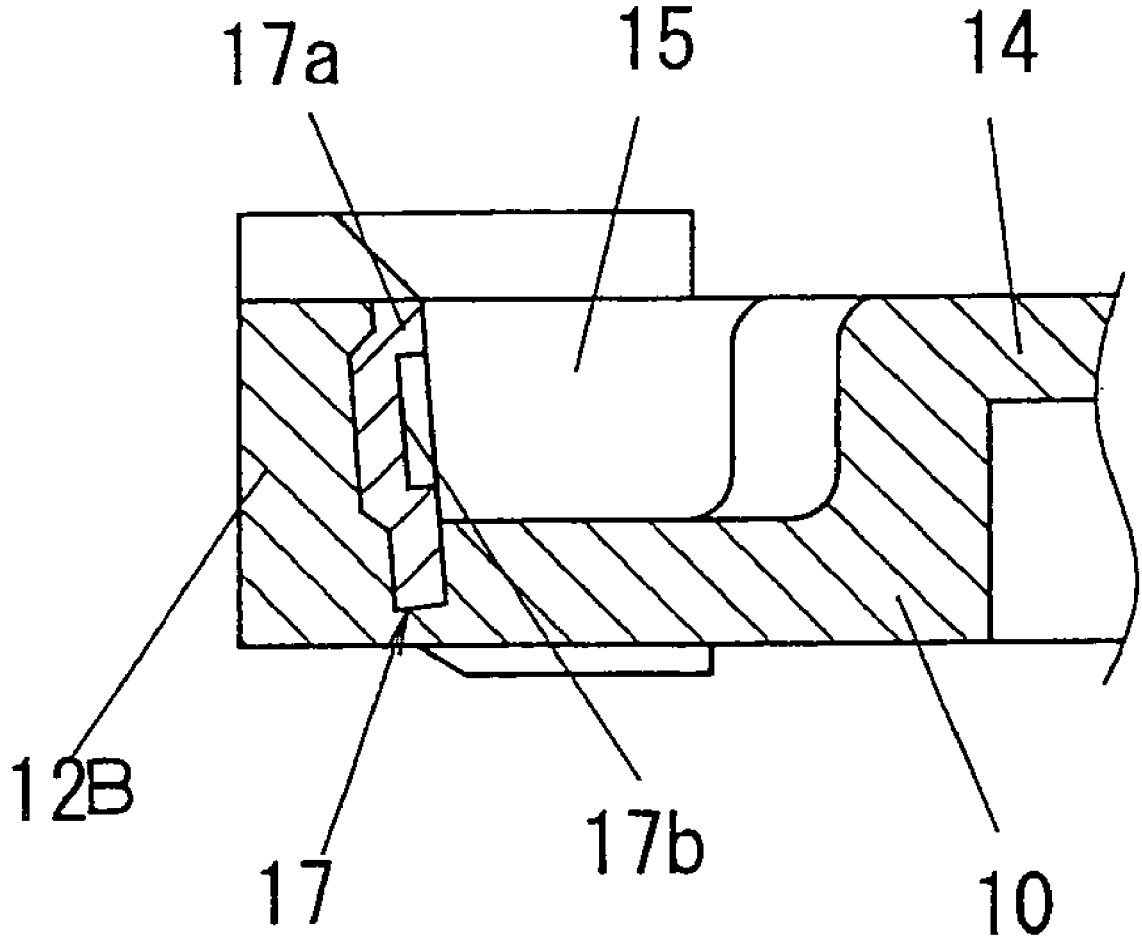
FIG. 9 is a sectional side view showing a detail of the socket reinforcing plate inserted in the socket.

A height of the socket body 10 is, for example, 0.8 mm so as to make the stacking height of the low-profile connector less than 1.0 mm. If the socket body 10 is formed only by resin molding, the possibility of occurrence of contortion or crack becomes higher due to the reduction of the strength. Thus, a pair of socket reinforcing plates 17 made of a metal thin plate is inserted into the end portions 12B of the peripheral wall 12 of the socket body 10, as shown in FIG. 6. FIG. 6 shows a state of the socket body 10 just after the insert molding process. As can be seen from FIG. 6, a plurality of socket reinforcing plates 17 are formed on a metal thin plate 3. A pair of metal thin plates 3 with the socket reinforcing plate 17 is inserted in a molding die, and melted insulation resin is injected into the molding die.

Thus, a plurality of socket bodies 10 with the socket reinforcing plates 17 are formed simultaneously. By cutting the socket reinforcing plates 17 at bridging portions 3*a* from the metal thin plate 3, the socket bodies 10 are separated. The socket reinforcing plate 17 is cut from the metal thin plate 3 in a manner so that the rest of each bridging portion 3*a*, which serves as a fixing portion 17*c*, is protruded outwardly from the outer face 12*c* of the peripheral wall 12 of the socket body 10, as shown in FIGS. 3 and 4. The socket reinforcing plates 17 are inserted along substantially the breadth of the end portions 12B of the peripheral wall 12.

Details of the socket reinforcing plate 17 are shown in FIGS. 7, 8A to 8D, and 9. The socket reinforcing plate 17 has a main portion 17*a* which is appeared on an inner face of the end portion 12B of the peripheral wall 12. A hooking recess 17*b* is formed substantially at the center of the main portion 17*a* in the widthwise direction. The hooking recess 17*b* is oblong in the widthwise direction formed by punching the main portion 17*a*. The shape of the hooking recess 17*b* is not restricted, so that rectangular, circular or elliptic shape can be accepted. Since the hooking recess 17*b* is not penetrated, the socket body 10 and the socket reinforcing plate 17 can be molded integrally by the insert molding process with using no sliding core when the molding die is formed for sealing the opening of the hooking recess 17*b* in the molding of the socket body 10. The main portion 17*a* is bent at a predetermined angle near to the right angle with respect to the fixing portions 17*c* corresponding to the rest of the bridging portions 3*a* of the metal thin plate 3.

Figure 10A:
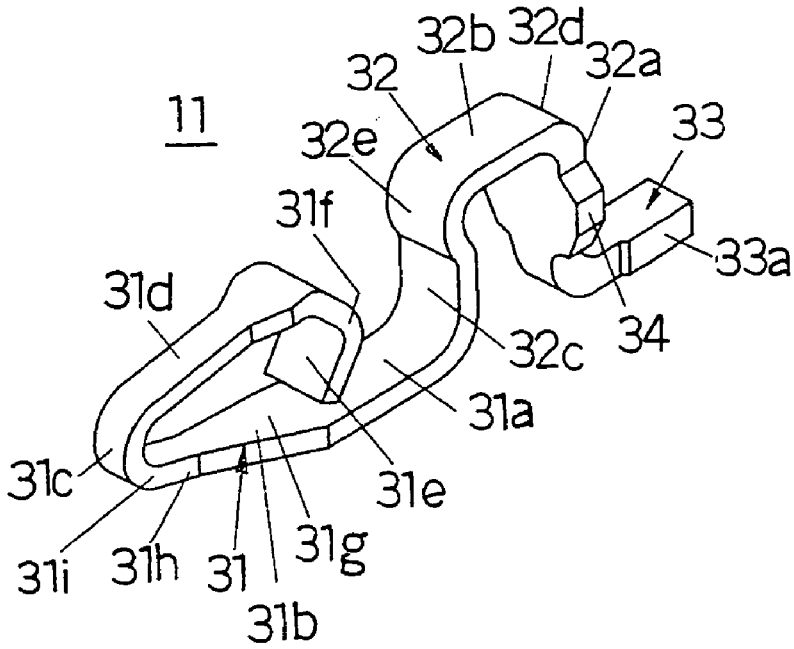
FIG. 10A is a front perspective view of a contact used in the socket.
Figure 10B:
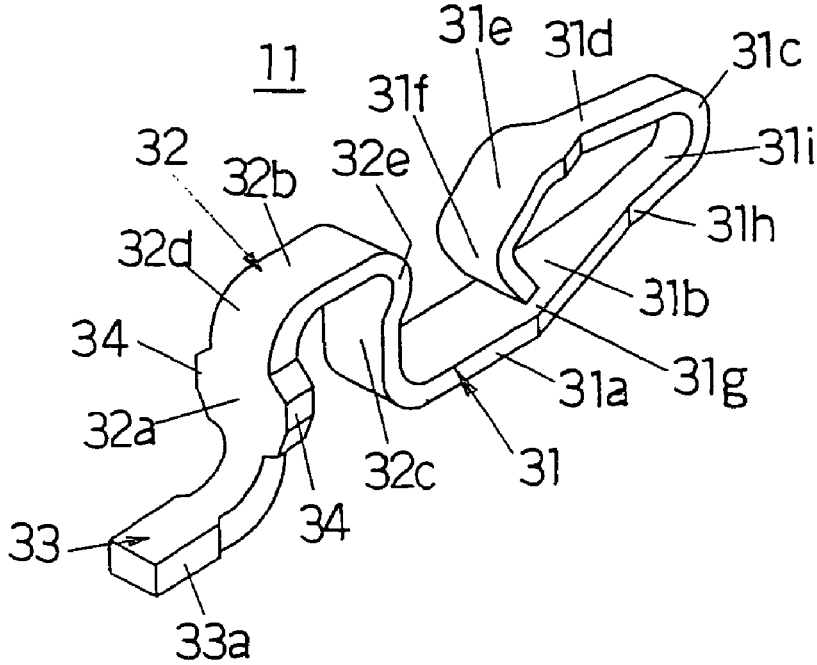
FIG. 10B is a rear perspective view of the contact.
Figure 11B:
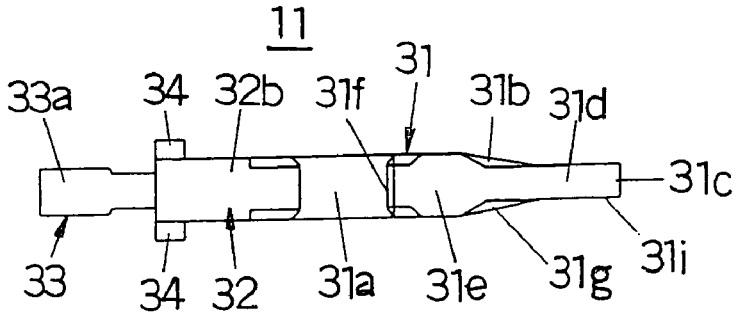
FIG. 11B is a top view of the contact.
Figure 11A:
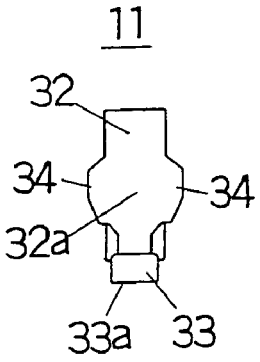
FIG. 11A is a front view of the contact.
Figure 11C:
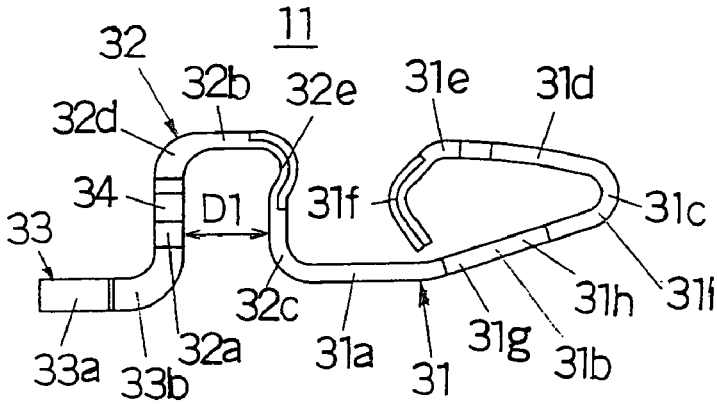
FIG. 11C is a side view of the contact.
Figure 11D:
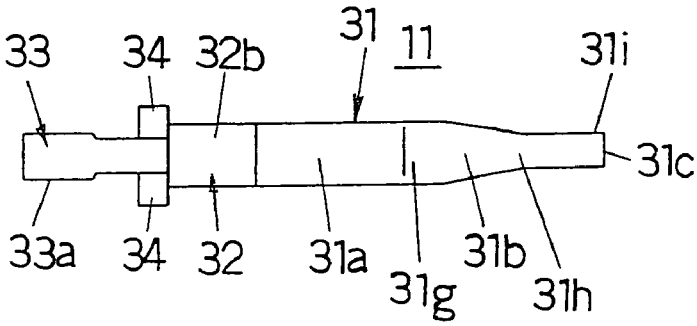
FIG. 11D is a bottom view of the contact.

The contact 11 is made of conductive metal thin plate such as beryllium copper, and formed be punching and bending the metal thin plate to a predetermined shape. Details of the contact 11 are described with reference to FIGS. 10A, 10B, and 11A to 11D. FIGS. 10A and 10B respectively show the front and rear perspective views of the contact 11. FIGS. 11A to 11D respectively show the front, top, side and bottom views of the contact 11.

The contact 11 has a plate spring portion 31, a reverse U-shaped fitting portion 32 and a terminal portion 33 which are integrally formed from a front end to a rear end of the contact 11. The fitting portion 32 further has a first arm 32*a*, a ceil portion 32*b*, a second arm 32*c*, a first curved portion 32*d* between the first arm 32*a* and the ceil portion 32*b*, a second curved portion 32*e* between the ceil portion 32*b* and the second arm 32*c*, and a pair of protrusions 34 formed substantially at the center of side faces of the first arm 32*a*. An outer face of the second curved portion 32*e* is a little protruded from an outer face of the second arm 32*c*. Furthermore, a distance D1 between the inner faces of the first arm 32*a* and the second arm 32*c* is made substantially the same as but a little smaller than a thickness of the peripheral wall 12 in the fitting groove 12*a*.

The terminal portion 33 further has a soldering terminal 33*a* formed by bending substantially at right angle for protruding outwardly from a lower end of the first arm 32*a* of the fitting portion 32, and a third curved portion 33*b* between the soldering terminal 33*a* and the lower end of the first arm 32*a* of the fitting portion 32. A width of the third curved portion 33*b* is a little narrower than a width of the soldering terminal 33*a*.

The protrusions 34 are protruded outwardly from the side faces of the first arm 32*a* so that a width between the protrusions 34 is made a little wider than the width of the fitting groove 12*a* on the peripheral wall 12 of the socket body 10. A width of the fitting portion 32 except the protrusions 34 is made a little wider than the width of the soldering terminal 33*a*, but a little narrower than the width of the fitting groove 12*a*.

A thickness of the contact 11 from the soldering terminal 33*a* to the first curved portion 32*d* of the fitting portion 32 is substantially the same as a thickness, for example, 0.1 mm of an original blank of the contact 11. Another thickness of the contact 11 from the first curved portion 32*d* of the fitting portion 32 to the plate spring portion 31 is made, for example, 0.08 mm, thinner than the thickness of the blank of the contact 11 by hammering the blank.

The plate spring portion 31 further has a lateral portion 31*a*, a first slanted portion 31*b*, a V-shaped fourth curved portion 31*c*, a second slanted portion 31*d*, and a doglegged contact portion 31*e*. The lateral portion 31*a* is formed by bending substantially at right angle for protruding inward from a lower end of the second arm 32*c* of the fitting portion 32. The width of the lateral portion 31*a* is the same as the width of the fitting portion 32 except the protrusions 34. The first slanted portion 31*b* is formed by bending at a predetermined angle from a top end of the lateral portion 31*a* in a manner so that a height at a top end 31*i* of the first slanted portion 31*b* becomes higher than a height at a rear end 31*g* of the first slanted portion 31*b*. Furthermore, a width at a mid portion 31*h* of the first slanted portion 31*b* is narrower than a width at the rear end 31*g* of the first slanted portion 31*b*. The fourth curved portion 31*c* is formed by bending from the top end 31*i* of the first slanted portion 31*b* so as to turn back substantially in the opposite direction. The second slanted portion 31*d* is formed as an elongation of the fourth curved portion 31*c*. The width of the fourth curved portion 31*c* and the second slanted portion 31*d* are the same as the width at the top end 31*i* of the first slanted portion 31*b*. The doglegged contact portion 31*e* is formed by incurving an elongation of the second slanted portion 31*d*. A width of the contact portion 31*e* is substantially the same as the width of the fitting portion 32 except the protrusions 34.

A peak 31*f* of the doglegged contact portion 31*e* is positioned substantially the same level as the inflection point of the fourth curved portion 31*c*. Since the width of the contact portion 31*e* is made the same as the lateral portion 31*a*, the clearances between the inner walls of the guide groove 14*a* on the table portion 14 of the socket base 10 and the side faces of the contact 11 become much smaller when the contact 11 is contained in the guide groove 14*a*. Thus, the movement of the contact 11 in a direction parallel to the arrangement of the contacts 11 is restricted, so that the deformation of the contact 11 can be prevented when the header 2 is coupled with the socket 1. Furthermore, the thickness of the plate spring portion 31 and a part of the fitting portion 32 including the second curved portion 32*e* is made thinner than the thickness of the blank of the contact 11 by hammering, so that the contacting pressure generated by warping of the contacting portion 31*e* can be increased owing to the work hardening. On the other hand, the thickness of the terminal portion 33 and the fitting portion 32 except the hammered portion is maintained the original thickness of the blank, so that a mechanical strength of the contact 11 suitable for preventing the deformation of the contact 11 can be maintained when the contact 11 is press-fitted into the fitting groove 12*a* of the socket 1 or when the header 2 is coupled with the socket 1.

For fixing the contacts 11 on the socket body 10, a blank of metal plate (not shown) is processed to form a comb having the same number, width and pitch of teeth as the arrangement of the contacts 11 in the socket 1. The comb is pressed or hammered out in a manner so that the thickness of at least a part of the comb, which will elastically contact with the contacting portions of the posts 21 of the header 2 serving as a counterpart connector when the socket 1 is coupled with the header 2, is made to be thinner than the thickness of the original blank of metal plate. Subsequently, the teeth of the comb are bent to form all the contacts 11 on one side of the socket 1. The fitting portions 32 of the contacts 11 on the same side of the socket 1 are press fitted into the fitting grooves 12*a* of the socket body 10 at the same time. After fixing the contacts 11 on the socket body 10 of the socket 1, the terminal portions 33 of the contacts 11 are cut from the blank of metal plate. Accordingly, the socket 1 is manufactured. At this time, the distance D1 between the inner faces of the first arm 32*a* and the second arm 32*c* is made substantially the same as or a little smaller than the thickness of the peripheral wall 12 in the fitting groove 12*a*, so that the fitting portion 32 of the contact 11 firmly grips the peripheral wall 12. Furthermore, the protrusions 34 of the fitting portion 32 of the contact 11 are press-fitted into the sidewalls of the fitting groove 12*a*. Thus, the contact 11 is firmly fixed on the socket body 10.

When the contact 11 is fitted into the fitting groove 12*a* on the side portion 12A of the peripheral wall 12 of the socket body 10, the plate spring portion 31 of the contact 11 is contained in the guide groove 14*a* of the table portion 14, and the terminal portion 33 is outwardly protruded from the side portion 12A of the peripheral wall 12. The outer face of the soldering terminal 33*a* of the terminal portion 33 of the contact 11 is a little protruded outwardly from the outer face 13*b* of the bottom wall 13 of the socket body 10. As shown in FIG. 2, when the socket 1 is fixed on the circuit board 5 by soldering the soldering terminals 33*a* on a printed circuit pattern on the circuit board 5, a gap is formed between the outer face of the lateral portion 31*a* of the plate spring portion 31 of the contact 11 and a surface 5*a* of the circuit board 5, which permits the warp or deformation of the plate spring portion 31 so as not to contact the outer face of the lateral portion 31*a* of the plate spring portion 31 with the circuit pattern on the circuit board 5.

Figure 12:
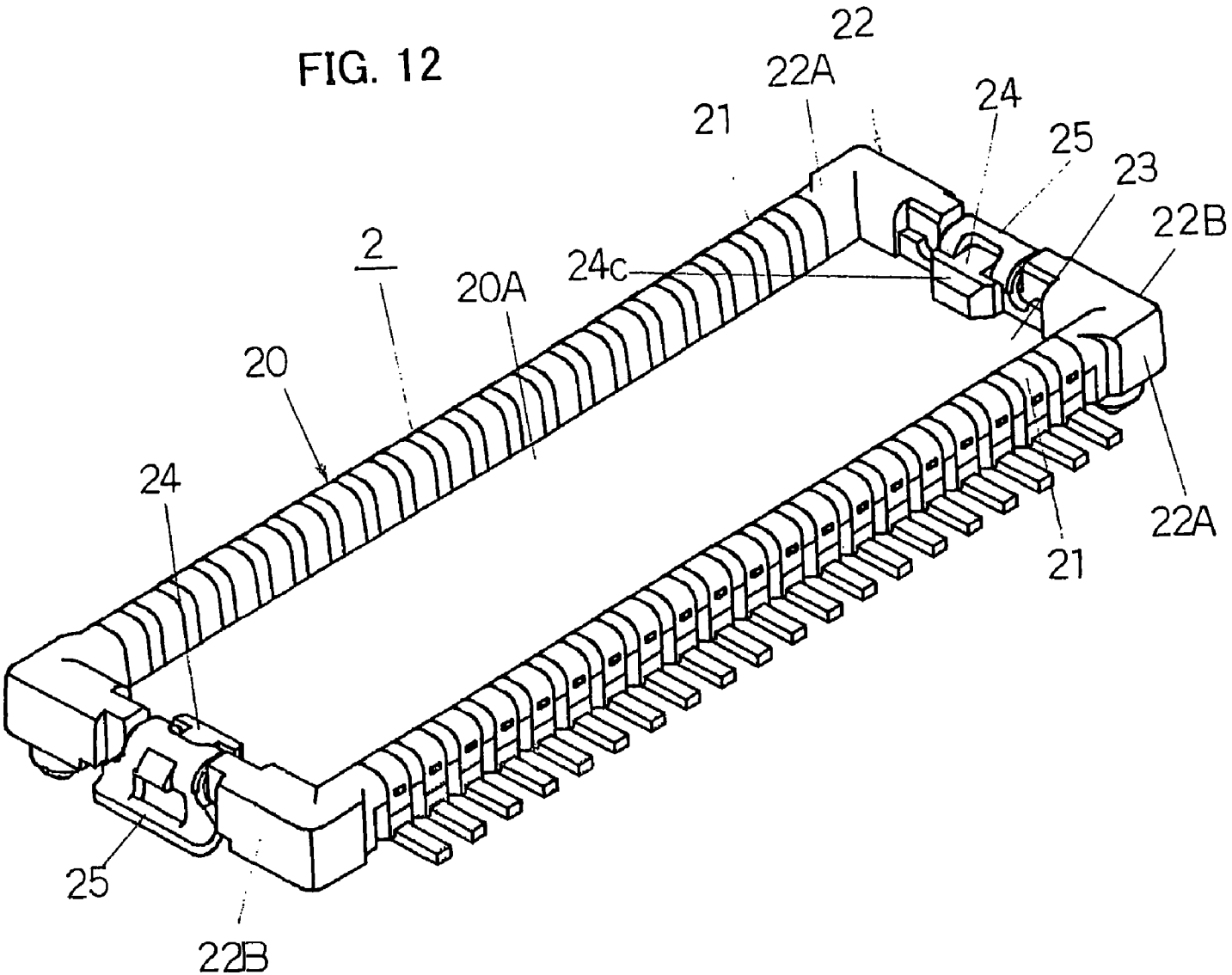
FIG. 12 is a perspective top view showing a configuration of the header.
Figure 13:
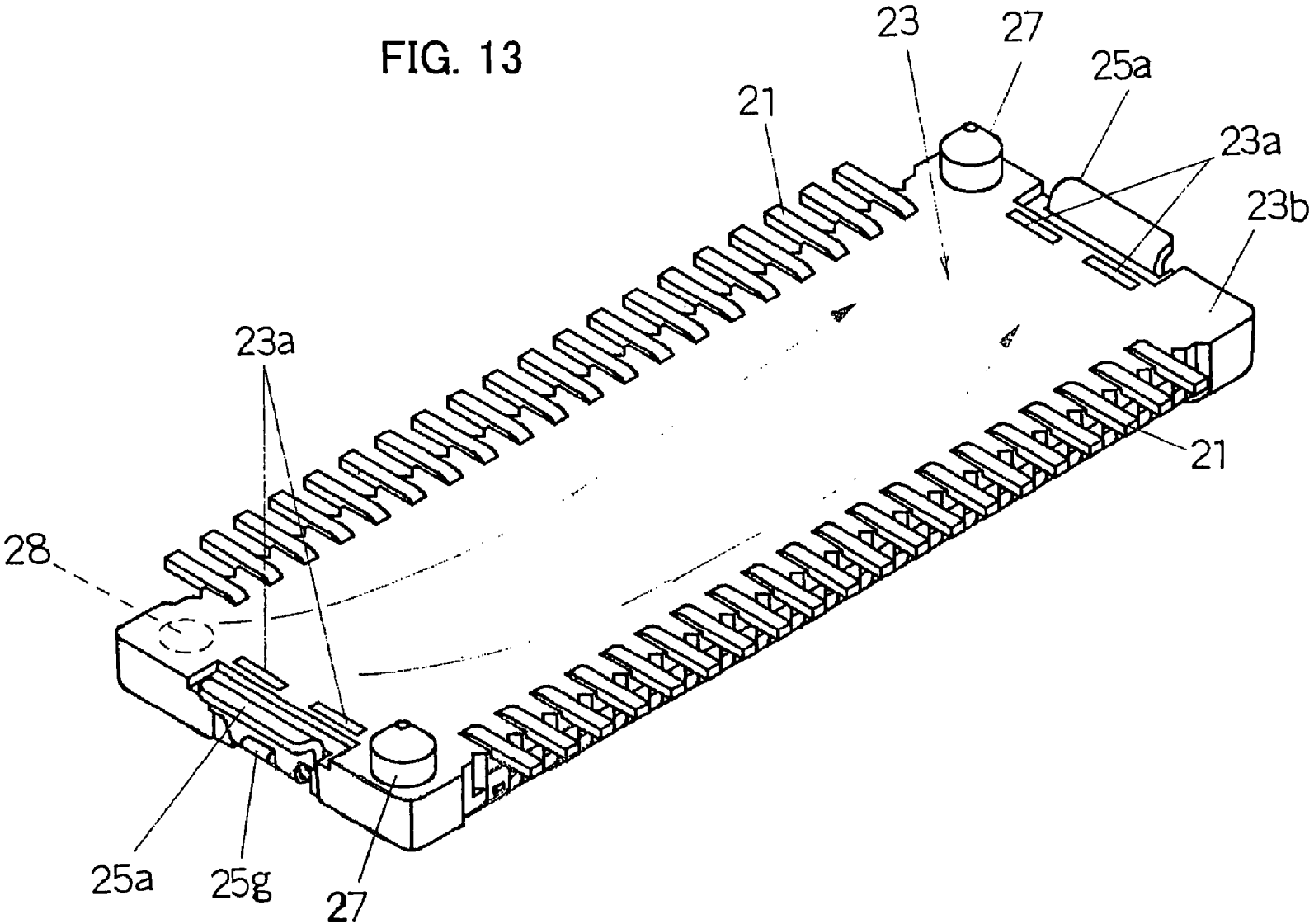
FIG. 13 is a perspective bottom view of the header.
Figure 14:
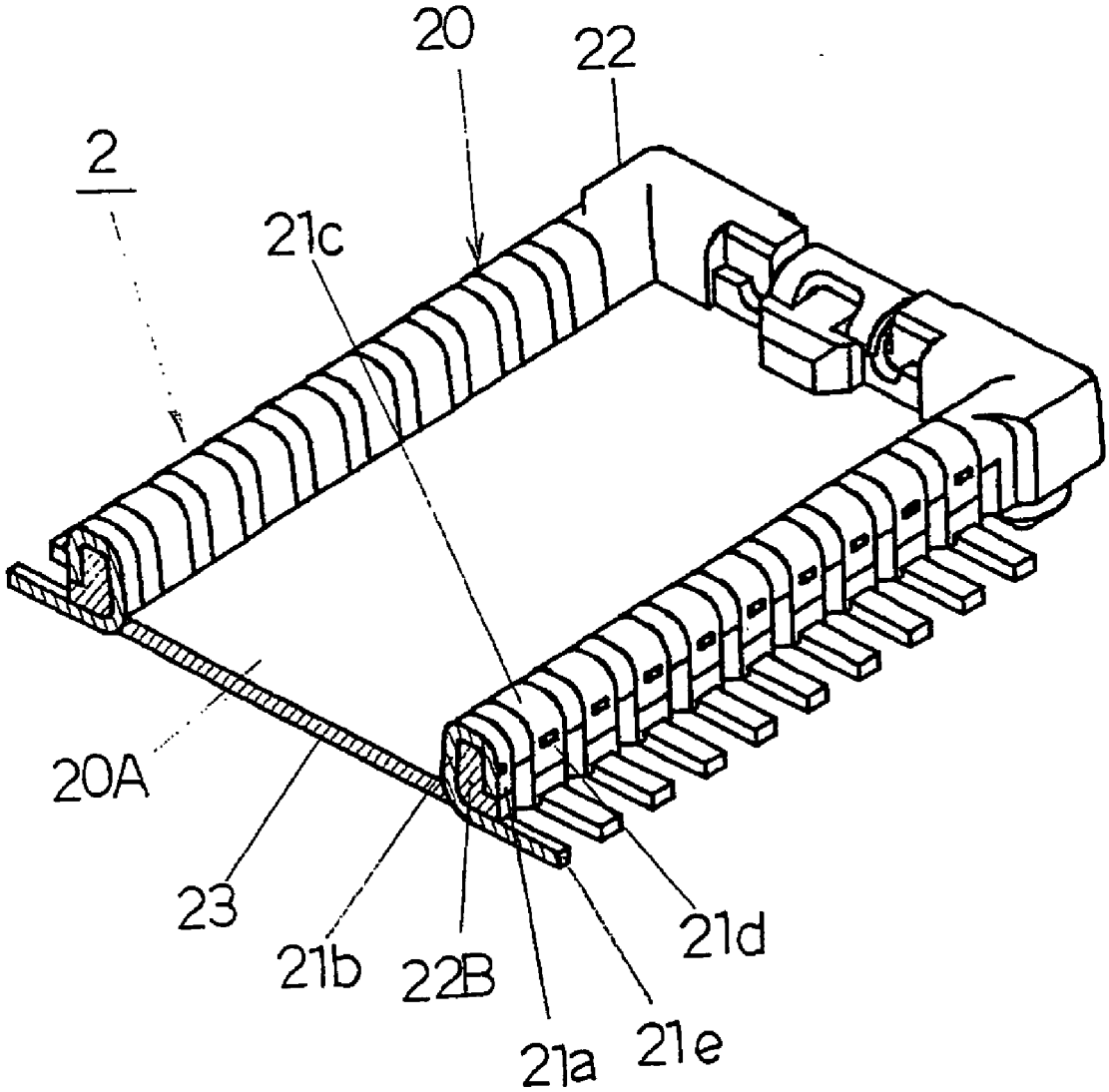
FIG. 14 is a sectional perspective top view of the header.

Subsequently, details of the header 2 is described with reference to FIGS. 12 to 14. FIG. 12 is a perspective top view of the header 2. FIG. 13 is a perspective bottom view of the header 2. FIG. 14 is a sectional perspective top view of the header 2.

As can be seen from FIGS. 12 to 14, the header 2 comprises a header body 20 having a rectangular parallelepiped shape and made of an insulation resin molding. The header body 20 has a peripheral wall 22 squarely enclosing an inner space 20A of the header body 20. A plurality of pairs of posts 21 (which may function as conductive terminals, for example) is arranged along two elongate side portions 22A of the peripheral wall 22. The peripheral wall 22 of the header body 20 has a bottom wall 23. The shape and the dimensions of the peripheral wall 22 are selected in a manner so that the peripheral wall 22 can be inserted into the coupling recess 15 of the socket body 10. A thickness of the side portion 22A of the peripheral wall 22 of the header body 20 is a little smaller than the width of the coupling recess 15 in a portion along the side portion 12A of the peripheral wall 12 of the socket body 10. Furthermore, the thickness of the side portion 22A of the peripheral wall 22 is selected to be substantially the same as a distance between the second curved portion 32*e* and the peak 31*f* of the contact portion 31*e* of the contact 11. Still furthermore, a pair of mounting legs 27 is formed for protruding outwardly at positions on an outer face of the bottom 23 in the vicinity of two corners symmetrical with respect to the center of the header body 20 (see FIG. 13). The mounting legs 27 will be fitted into positioning holes provided on a circuit board (not shown), so that the header 2 can be positioned on the circuit board. Top ends of the mounting legs 27 are tapered so that the mounting legs 27 can easily be inserted into the positioning holes.

Figure 15A:
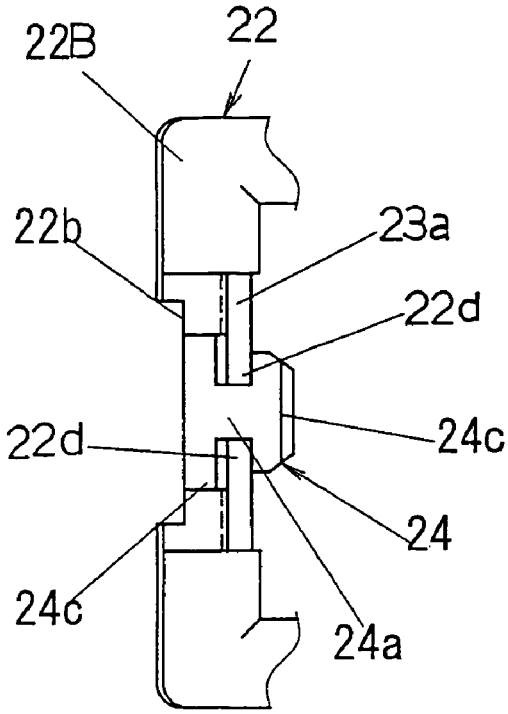
FIG. 15A is a plan view of an end portion of a peripheral wall of a header body.
Figure 15B:
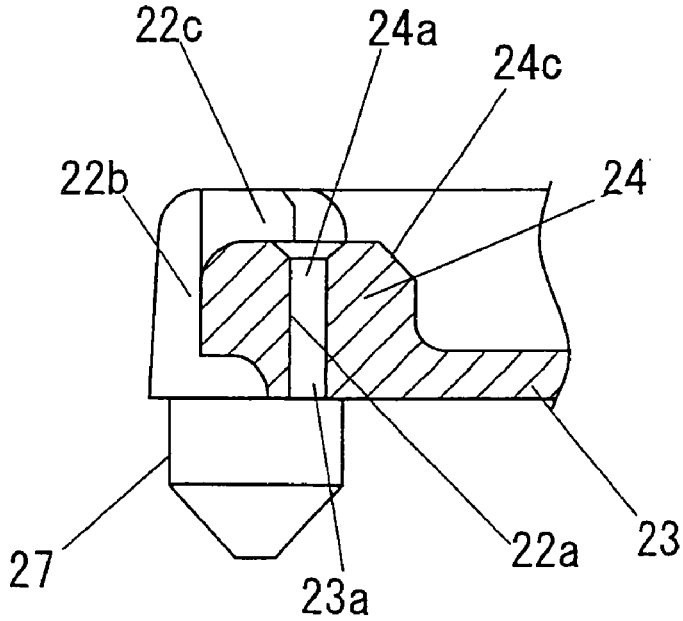
FIG. 15B is a sectional side view of the end portion of the peripheral wall of the header body.
Figure 16A:
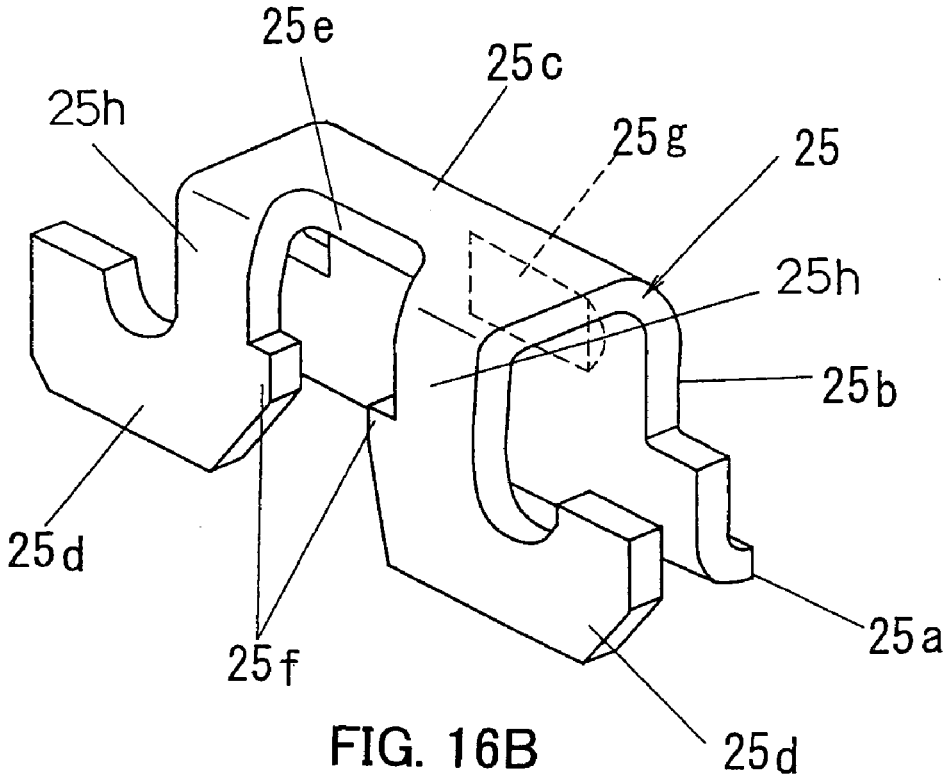
FIG. 16A is a perspective rear view of a header reinforcing plate.
Figure 16B:
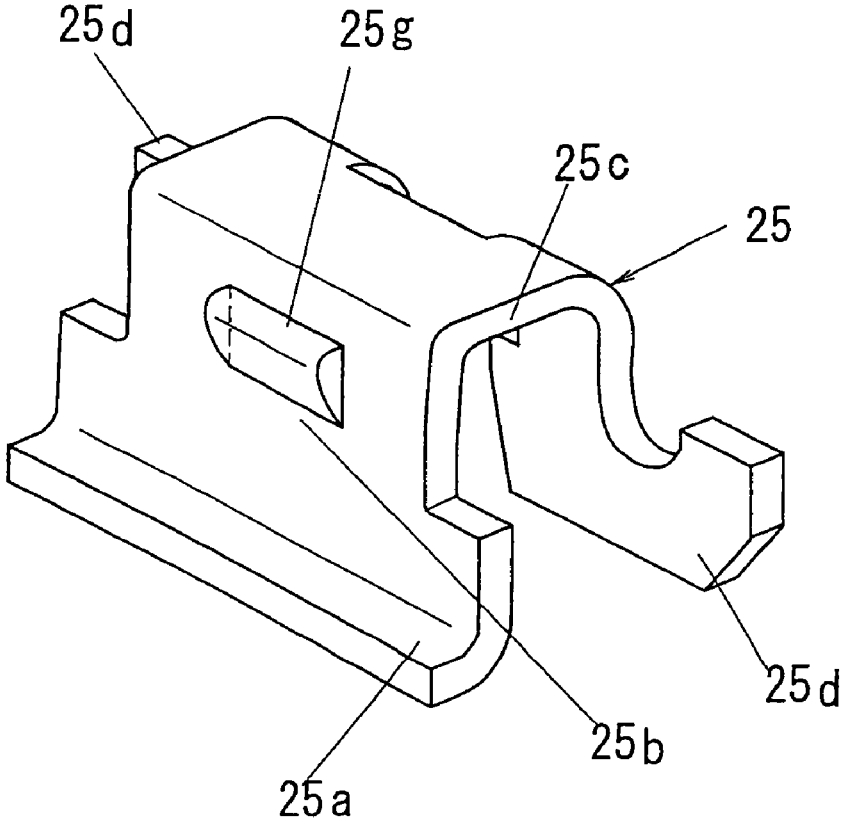
FIG. 16B is a perspective front view of the header reinforcing plate.
Figure 17A:
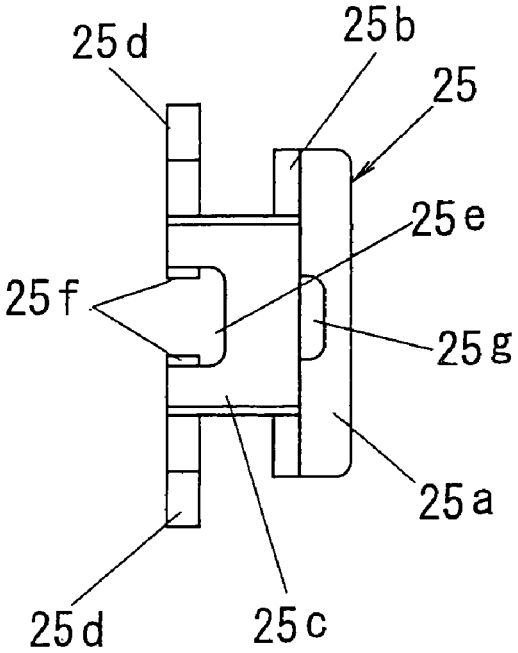
FIG. 17A is a top view of the header reinforcing plate.
Figure 17B:
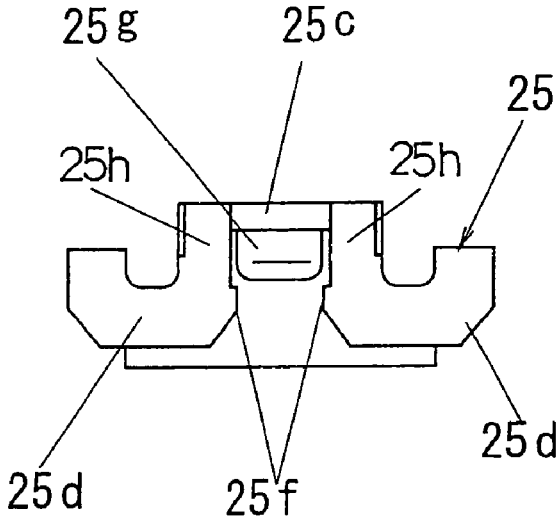
FIG. 17B is a rear view of the header reinforcing plate.
Figure 17C:
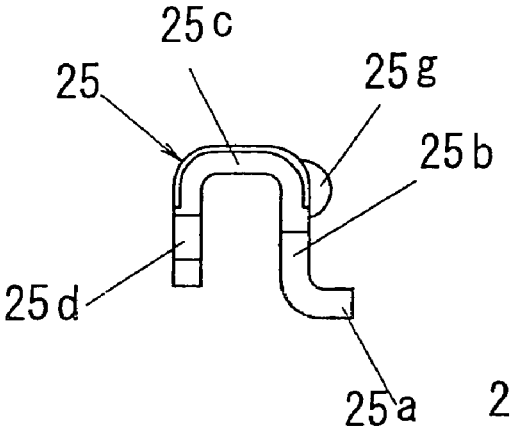
FIG. 17C is a side view of the header reinforcing plate.
Figure 17D:
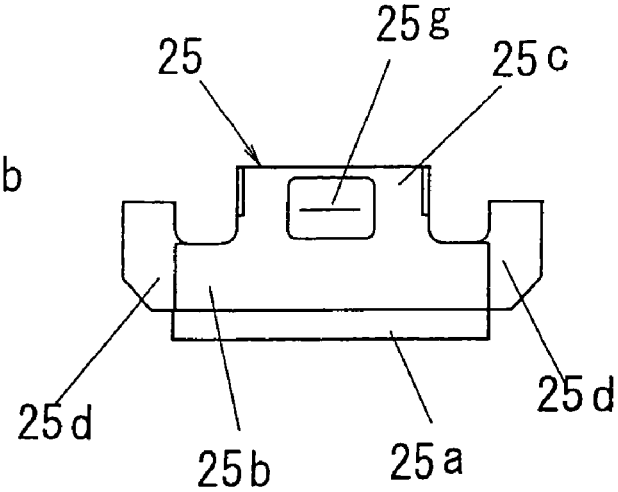
FIG. 17D is a front view of the header reinforcing plate.

FIG. 15A shows a plan view of an end portion 22B of the peripheral wall 22 of the header body 20, and FIG. 15B shows a sectional side view thereof. An inner recess 22*a* is formed on an inner face of each end portion 22B of the peripheral wall 22 of the header body 20. A T-shaped projection 24 is further formed for protruding inwardly to the inner space 20A from the center of the inner recess 22*a*. Since the projection 24 has the T-shape in a plan view of the header body 20, a pair of gaps 22*d* is formed between the projection 24 and the inner face of the end portion 22B of the peripheral wall 22 in the inner recess 22*a*. Chamfers 24*c* are formed at front edges of the projection 24. As shown in FIG. 13, two pairs of through holes 23*a* are formed on the bottom wall 23 of the header body 20, which are the traces of cores of a molding die for forming the projections 24 as the T-shape. An outer recess 22*b* is formed on an outer face of each end portion 22B of the peripheral wall 22 of the header body 20 opposite to the inner recess 22*a*. A channel 22*c* is formed on a top face of the end portion 22B of the peripheral wall 22 of the header body 20 for communicating the inner recess 22*a* and the outer recess 22*b*. A width of the channel 22*c* in a widthwise direction parallel to the end portion 22B of the peripheral wall 22 is smaller than a width of the outer recess 22*b*, and the width of the outer recess 22*b* is narrower than a width the inner recess 22*a*.

When the height of the socket body 10 is selected to be 0.8 mm so as to make the stacking height of the low-profile connector less than 1.0 mm, a height of the header body 20 is selected to be, for example, 0.58 mm. Thus, a pair of header reinforcing plates 25 made of a metal thin plate is fitted into the end portions 22B of the peripheral wall 22 of the header body 20.

Details of the header reinforcing plate 25 are described with reference to FIGS. 16A, 16B, and 17A to 17D. The header reinforcing plate 25 has a fixing portion 25*a* which is to be soldered on a circuit board, a reverse U-shaped bridging portion 25*c* which overstrides the end portion 22B of the peripheral wall 22 from the outer recess 22*b* to the inner recess 22*a* and a pair of fitting portions 25*d* which are press-fitted into the gaps 22*d* between the inner face of the end portion 22B of the peripheral wall 22 and the T-shaped projection 24 in the inner recess 22*a*. The fixing portion 25*a* is bent substantially at right angle outwardly from a lower end of a first arm 25*b* of the bridging portion 25*c* in a direction opposite to the reverse U-section of the bridging portion 25*c*. A cutting 25*e* is formed for separating second arms 25*h* of the bridging portion 25*c*, so that the fitting portions 25*d* are respectively formed on the elongations of the second arms 25*h*. A protrusion 25*f* is formed at an inner edge of each fitting portion 25*d* facing the cutting 25*e*, by which a gap between the fitting portions 25*d* is made narrower. On the other hand, a hooking protrusion 25*g* is formed substantially at the center of the first arm 25*b* so as to protrude outwardly.

A width of the fixing portion 25*a* and a lower end portion of the first arm 25*b* is substantially the same as but a little narrower than the width of the outer recess 22*b* of the end portion 22B of the peripheral wall 22. A width of the bridging portion 25*c* except the lower end portion of the first arm 25*b* is substantially the same as but a little narrower than the width of the channel 22*c*. A width between both outer sides of the fitting portions 25*d* is substantially the same as but a little wider than the width of the inner recess 22*a*. A width of the gap between the protrusions 25*f* of the fitting portions 25*d* is substantially the same as but a little narrower than a width of a center wall 24*a* of the T-shaped projection 24.

The header reinforcing plate 25 is fitted into the end portion 22B of the peripheral wall 22 of the header body 20 in a manner so that the fitting portions 25*d* are press-fitted into the gaps between the inner recess 22*a* and the T-shaped projection 24, the bridging portion 22*c* is fitted into the channel 22*c* and the fixing portion 25*a* and the lower end portion of the first arm 25*b* are fitted into the outer recess 22*b*. Thus, the header reinforcing plate 25 is firmly fixed on the header body 20. The lower end portions of the fitting portions 25*d* can be inserted into the through holes 23*a*, so that the header reinforcing plate 25 can precisely be positioned on the header body 20.

As shown in FIG. 13, the fixing portions 25*a* are protruded outwardly from the end faces of the header body 20 when the header reinforcing plate 25 is fitted into the header body 20. The outer face of the fixing portion 25*a* is further protruded from the outer face 23*b* of the bottom wall 23 of the header body 20.

The hooking protrusion 25*g* of the header reinforcing plate 25 will be engaged with the hooking recess 17*b* of the socket reinforcing plate 17 when the header 2 is coupled with the socket 1. At this time, the header reinforcing plate 25 and the socket reinforcing plate 17 are respectively fixed on the circuit board by soldering. On the other hand, it is necessary that the header reinforcing plate 25 and/or the socket reinforcing plate 17 can be warped for engaging the hooking protrusion 25*g* with the hooking recess 17*b*. In this embodiment, the reverse U-shaped bridging portion 25*c* of the header reinforcing plate 25 is not tightly fitted to the end portion 22B of the peripheral wall 22, so that the bridging portion 25*c* of the header reinforcing plate 25 can be moved or warped a little in a direction for coupling the header 2 with the socket 1. Thus, the header 2 can be coupled with the socket 1.

Hereupon, the header body 20 has a shape that the peripheral wall 22 encloses the rectangular bottom wall 23. For forming the header body 20 by injection molding of insulation resin, melted resin is injected through a gate formed on a molding die correspondingly at a position on an outer face of the header body 20. An example of the position of the gate 28 positioned at an upper left portion of the bottom wall 23 is illustrated in FIG. 13. In this example, the melted resin flows from the bottom wall 23 to the peripheral wall 22 in the molding die as shown by arrows. Thus, weld mark can easily be appeared along a centerline of the bottom wall 23 in the longitudinal direction. When an external force is applied in a direction for pulling the side portions 22A of the peripheral wall 22 apart from each other, a crack can easily occur in the header body 20. In this embodiment, the header reinforcing plate 25 has two fitting portions 25*d* which are symmetrically press-fitted into the end portion 22B of the peripheral wall 22, so that the header reinforcing plate 25 makes the header body 20 tough against the external force. Thus, the possibility of occurrence of the crack in the header body 20 can be reduced.

The posts 21 held on the header body 20 are inserted into the header body 20 by the insert molding process. As shown in FIG. 2, the post 21 has substantially P-shaped section which is formed by rolling a top end portion of a metal thin plate. A first contact portion 21*a* with a protrusion 21*d*, a second contact portion 21*b* and a ceil portion 21*c* are formed as a U-shaped section in a manner so that the first contacting portion 21*a* and the second contacting portion 21*b* are substantially parallel with each other. The first contact portion 21*a* appears on an outer face of the peripheral wall 22 of the header body 20. The second contact portion 21*b* appears on an inner face of the peripheral wall 22. A soldering terminal 21*e* is formed by bending substantially at right angle from the upper end of the second contact portion 21*b*.

As mentioned above, the posts 21 are inserted in the header body 20 which is formed by resin molding. For fixing the posts 21 on the molding die (not shown), a blank of metal plate (not shown) is processed to form a comb having the same number, width and pitch of teeth as the arrangement of the posts 21 in the header 2. The teeth of the comb are bent or rolled to form the posts 21 on one side of the header 2. A pair of blanks is disposed at predetermined positions of the molding die, and the melted resin is injected into the molding die. After forming the header body 20 with the blanks of metal plate, the soldering terminals 21*e* of the posts 21 are cut from the blank of metal plate. Accordingly, the header 2 is manufactured.

The portion of the resin filled in an inner hollow of the post 21 serves as a part of the side portion 22A of the peripheral wall 22. In other words, the first contact portion 21*a*, the second contact portion 21*b* and a part of the soldering terminal 21*e* of the post 21 are wound around the side portion 22A of the peripheral wall 22. Outer faces of the post 21 are substantially the same level as or a little protruded from outer faces of the other portions of the side portion 22A of the peripheral wall 22. Since no resin film covers the outer faces of the post 21, the posts 21 can electrically be contacted with the contacts 11 of the socket 1 when the header 2 is coupled with the socket 1.

As can be seen from FIG. 2, the post 21 contacts with the contact 11 at two points on the first contact portion 21*a* and the second contact portion 21*b*. The protrusion 21*d* on the first contact portion 21*a* hooks the lower edge of the second curved portion 32*e* of the contact 11 and electrically contacts with the second arm 32*c* of the fitting portion 32. Furthermore, the second contact portion 21*b* contacts with the peak 31*f* of the contact portion 31*e* of the contact 11. The contact of the second contact portion 21*b* of the post 21 with the contact portion 31*e* of the contact 11 serves as a main contact, and the contact of the first contact portion 21*a* with the second arm 32*c* of the contact 11 serves as a auxiliary contact. By hooking the protrusion 21*d* on the first contact portion 21*a* of the post 21 with the lower edge of the second curved portion 32*e* of the contact 11, the counteraction against an external force for pulling out the header 2 from the socket 1 can be increased.

Figure 18:
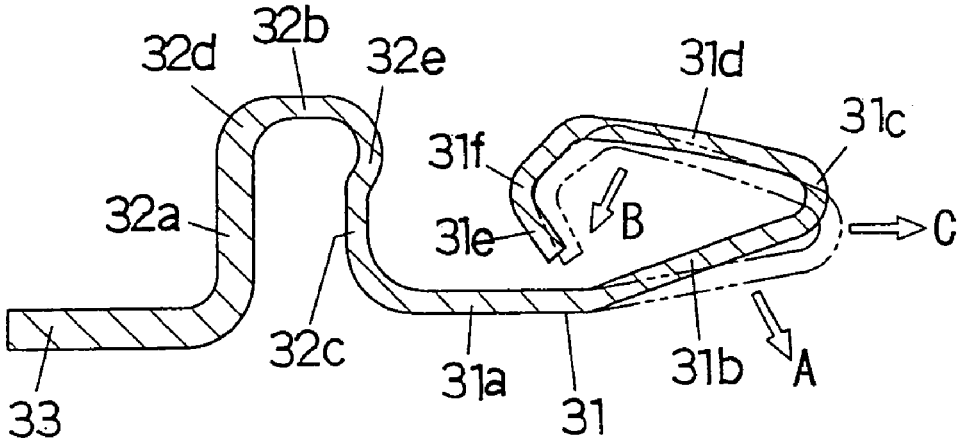
FIG. 18 is a side view for showing warp of the contact when the header is coupled with the socket.

Action of the contact 11 when the header 2 is coupled with the socket 1 is described with reference to FIG. 18. For coupling the header 2 with the socket 1, the post 21 of the header 2 is forcibly inserted in a gap between the second arm 32*c* of the fitting portion 32 and the peak 31*f* of the contact portion 31*e* of the contact 11 of the socket 1. Lower end of the post 21 contacts the upper slanted portion of the contact portion 31*e*, and applies a downward force and a lateral force to the contact 11. Thus, the plate spring portion 31 of the contact 11 wholly warps as illustrated by two-dotted chain line in FIG. 18. The first slanted portion 31*b* is warped downward in a direction shown by arrow A, the second slanted portion 31*d* warps downward in a direction shown by arrow B, and the V-shaped fourth curved portion 31*c* is moved in a direction shown by arrow C. Thereby, deformation of the contact 11 due to buckling can be prevented. A lower end of the contact portion 31*e* moves downward and contacts with a boundary portion between the lateral portion 31*a* and the first slanted portion 31*b*. When the movement of the contact portion 31*e* is stopped, the lower end of the post 21 climbs over the peak 31*f* of the contact portion 31*e* of the contact 11, and the second contact portion 21*b* of the post 21 contacts with the contact portion 31*e* of the contact 11. Simultaneously, the protrusion 21*d* on the first contact portion 21*a* of the post 21 climbs over the second curved portion 32*c* of the contact 11 and hooks with the lower edge thereof and electrically contacts with the second arm 32*c* of the fitting portion 32 of the contact 11.

Figure 19:
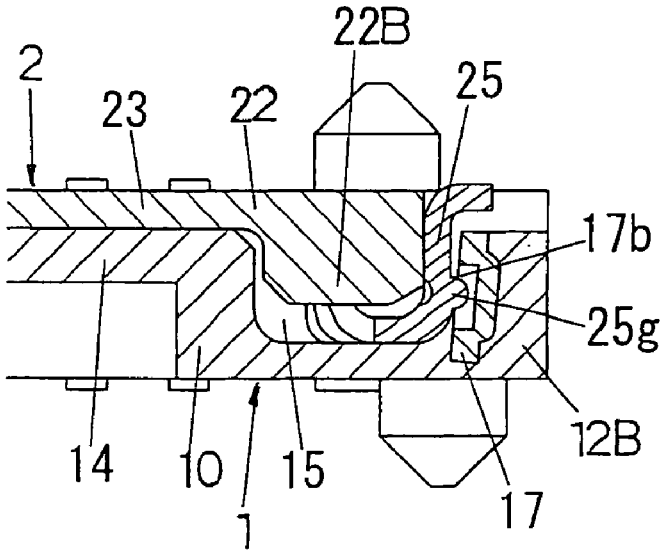
FIG. 19 is a sectional side view for showing engagement of a hooking protrusion of the header reinforcing plate with a hooking recess of the socket reinforcing plate.

Furthermore, the hooking protrusions 25*g* of the header reinforcing plates 25 provided on both ends of the header 2 are engaged with the hooking recesses 17*b* of the socket reinforcing plate 17 provided on both ends of the socket 1, as shown in FIG. 19. Thus, the peripheral wall 22 of the header body 20 of the header 2 is completely fitted into the coupling recess 15 of the socket body 10 of the socket 1.

When external force for pushing the header 2 to the socket 1 is removed, elastic reaction force charged in the plate spring portion 31 is released for restituting the contact 11. The peak 31*f* of the contact portion 31*e* of the contact 11 slides on the second contact portion 21*b* of the post 21 upwardly. Thus, the post 21 is moved upwardly by friction force acted between the contact portion 31*e* of the contact 11 and the second contact portion 21*b* of the post 21. Since the post 21 exists between the second arm 32*c* of the fitting portion 32 and the peak 31*f* of the contact portion 31*e*, the contact 11 cannot restitute to the origin and the plate spring portion 31 generates a predetermined contact pressure for contacting the contact 11 with the post 21.

By such a configuration, since the lower end of the post 21 which contacts the contact 11 first is rolled to form the U-shaped contact portion, no shear plane is appeared on the surface of the post 21 inserted in the header body 20. Thus, the contact 11 may not be caught on the post 21 when the header 2 is coupled with the socket 1 and the contact 11 may not be deformed. Furthermore, since the plate spring portion 31 of the contact 11 is rolled, the plate spring portion 31 can have a sufficient length for generating a necessary contact pressure, and the stress in the plate spring portion 31 can be reduced. Still furthermore, the width of the first slanted portion 31*b* is made gradually narrower for dispersing the stress, so that the stress concentration in the V-shaped fourth curved portion 31*c* can be prevented.

Furthermore, when the hooking protrusions 25*g* of the header reinforcing plates 25 are engaged with the hooking recesses 17*b* of the socket reinforcing plate 17, clicking shock occurs so that the user can feel that the header 2 is coupled with the socket 1. Furthermore, since the header reinforcing plate 25 and the socket reinforcing plate 17 are made of metal plate, so that the hooking protrusion 25*g* rarely wears and the clicking shock can be maintained even when coupling and decoupling are repeated. Still furthermore, when the header 2 is coupled with the socket 1, the peripheral wall 22 of the header body 20 of the header 2 is guided by the chamfer 15*a* on the peripheral wall 12 of the socket body 10 of the socket 1, so that the header 2 can easily be positioned with respect to the socket 1. Still furthermore, the header 2 can also be positioned with respect to the socket 1 by contacting the projections 24 provided on the header body 20 with the recesses 14*b* provided on both ends of the table portion 14 of the socket body 10. After coupling the header 2 with the socket 1, the projections 24 of the header body 20 are fitted into the recesses 14*b* of the socket body 10, so that displacement of the header 2 with respect to the socket 1 can be prevented.

Figure 20:
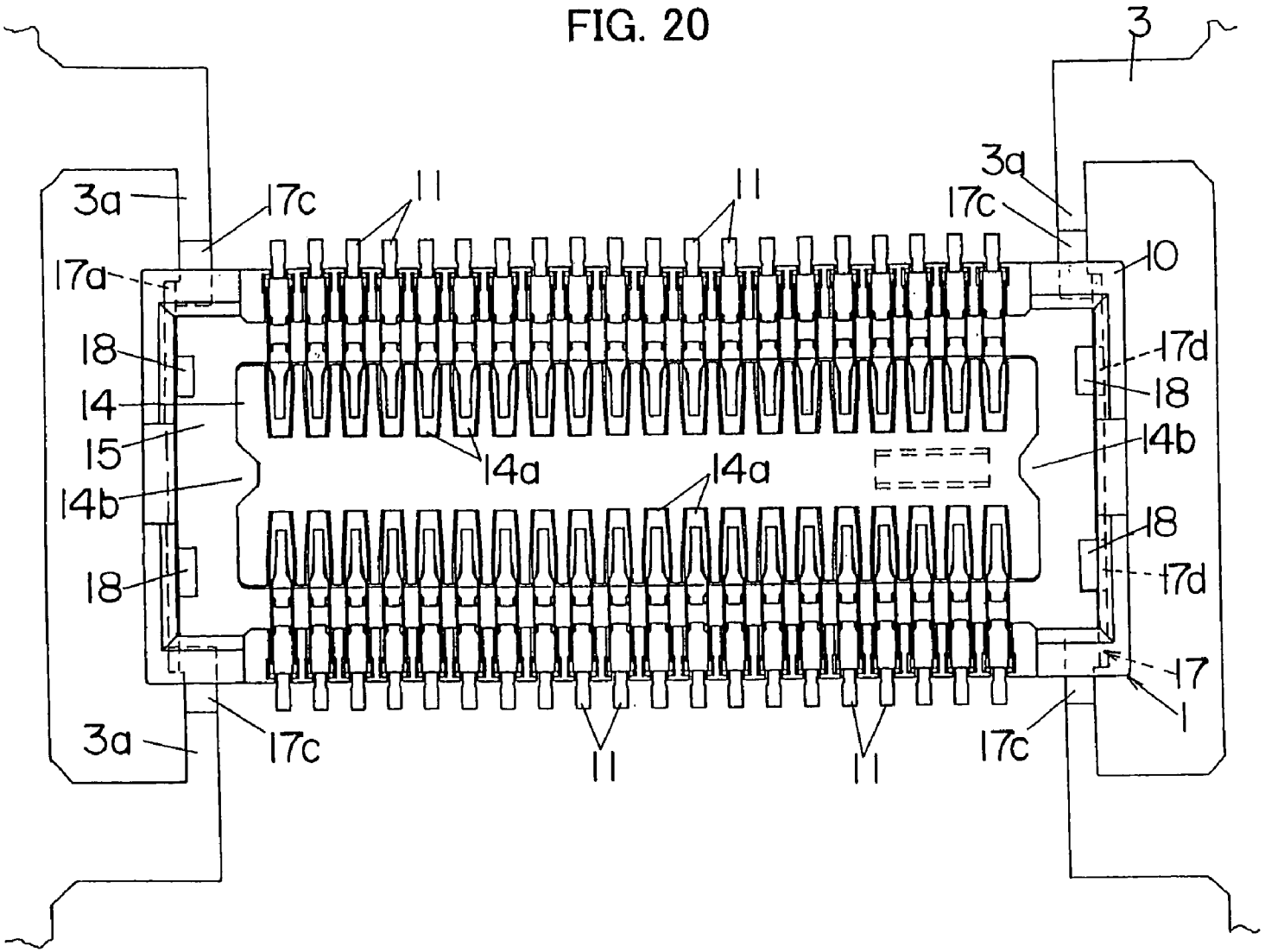
FIG. 20 is a plan view of a socket in a modification of the connector in accordance with the present invention.
Figure 21:
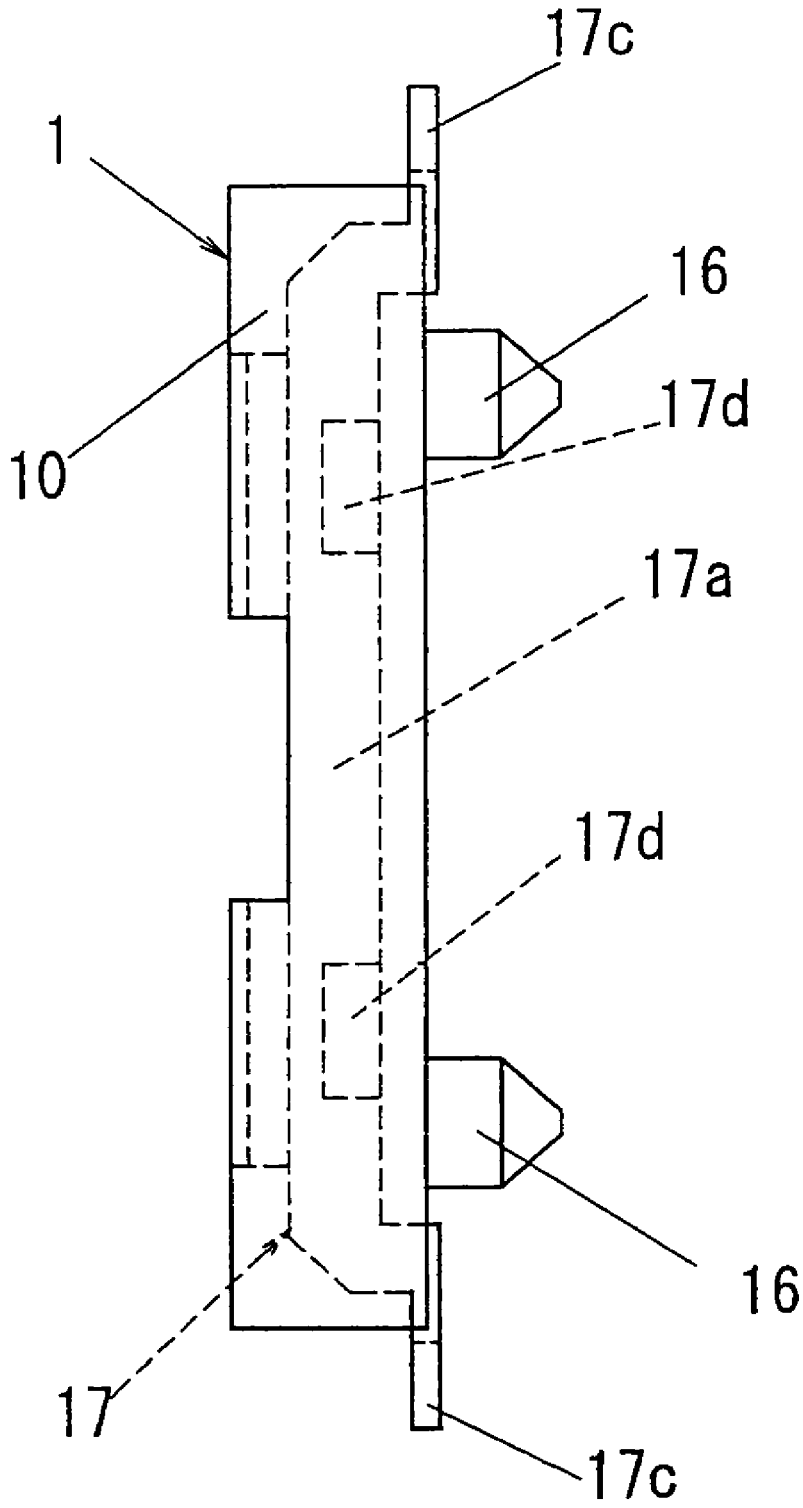
FIG. 21 is a front view of the socket in the modification.
Figure 26:
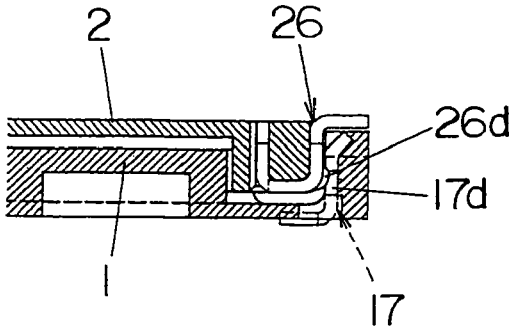
FIG. 26 is a sectional side view showing coupling of the header and the socket in the modification.

A modification of the connector is described with reference to FIGS. 20 to 26. In this modification, two cuttings 17*d* are formed on each socket reinforcing plate 17 as shown in FIGS. 20, 21 and 23. Correspondingly to the cuttings 17*d*, two hooking protrusions 26*d* are formed on each header reinforcing plate 26, which can be engaged with the cuttings 17*d* of the socket reinforcing plate 17 as shown in FIG. 26. Furthermore, the header reinforcing plate 26 is inserted into the header body 20 when the header body 20 is formed of injection molding.

Figure 22:
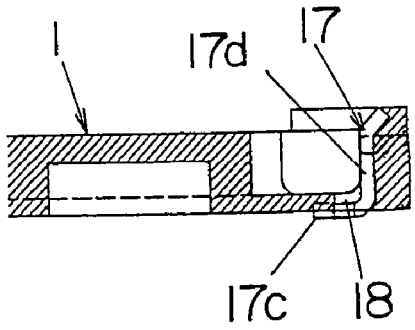
FIG. 22 is a sectional side view showing the socket reinforcing plate inserted in the end portion of the peripheral wall of the socket body in the modification.
Figure 23:
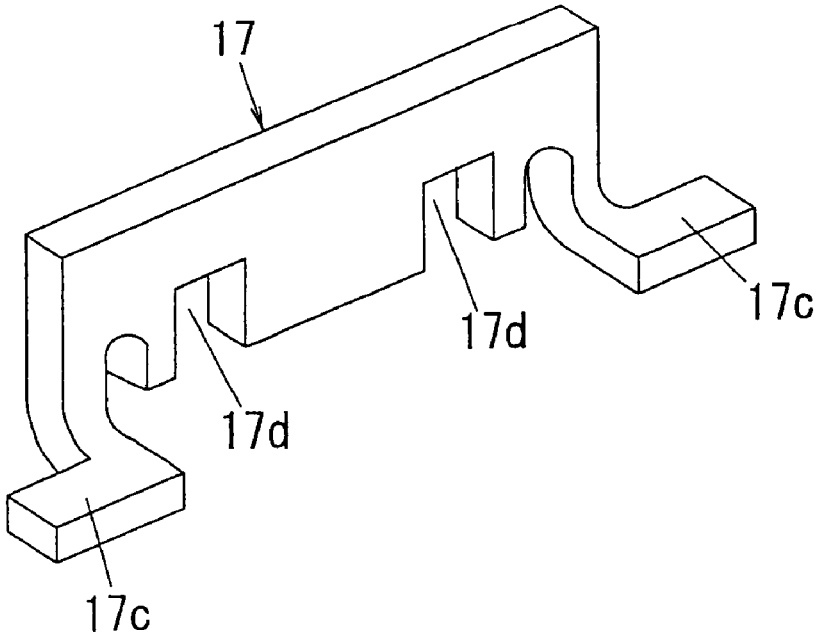
FIG. 23 is a perspective view showing a configuration of the socket reinforcing plate in the modification.

In this modification, the socket reinforcing plate 17 is inserted substantially for penetrating the end portion 12B of the peripheral wall 12 of the socket body 10, as shown in FIG. 22. It is necessary to cover the socket reinforcing plate 17 so as not to fill the resin into the cuttings 17*d*, while the injection molding of the socket body 10, for communicating the cuttings 17*d* of the socket reinforcing plate 17 with the coupling recess 15. Thus, sliding cores are engaged with the cuttings 17*d* of the socket reinforcing plate 17 in a molding die. Four through holes 18 illustrated in FIGS. 20 and 22 are the traces of the sliding cores.

Figure 24:
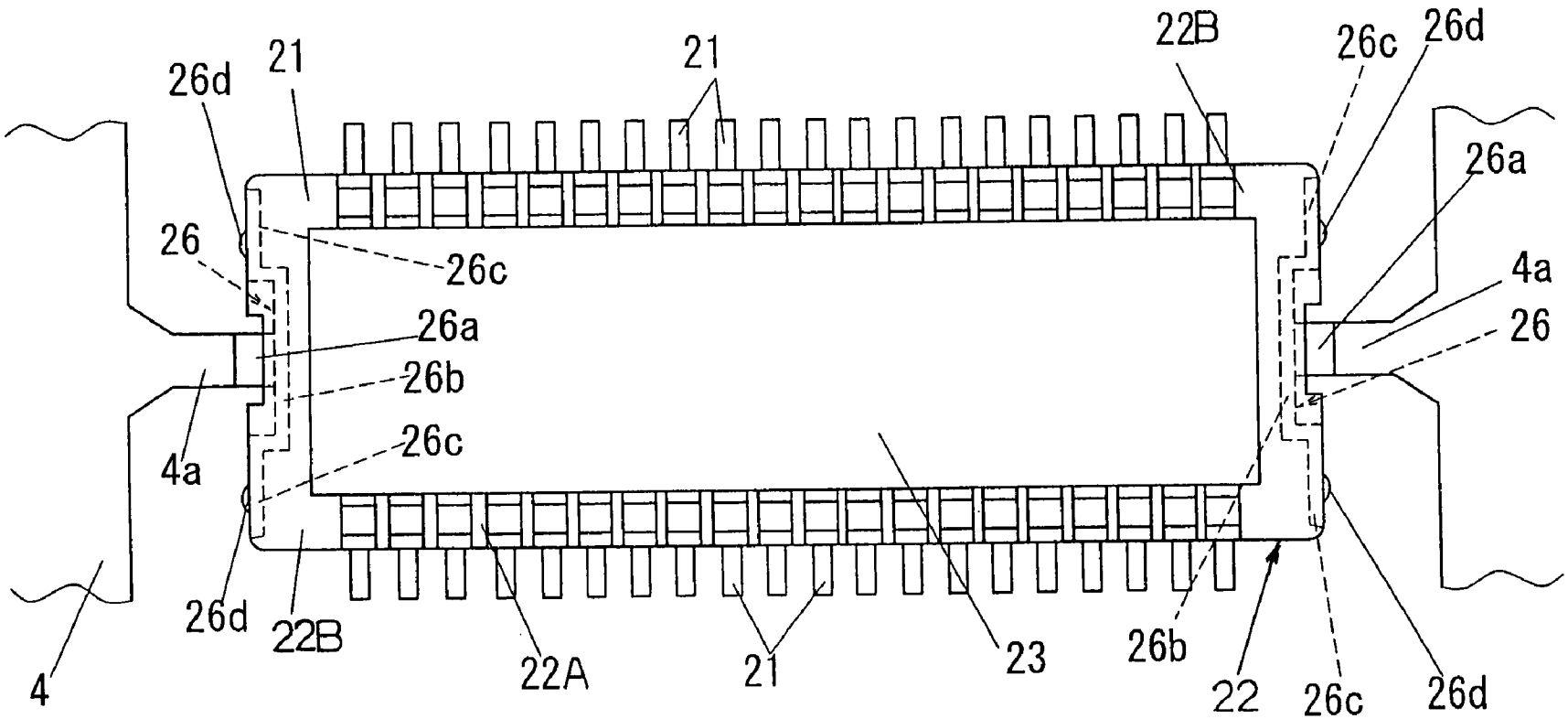
FIG. 24 is a plan view of a header in the modification.
Figure 25:
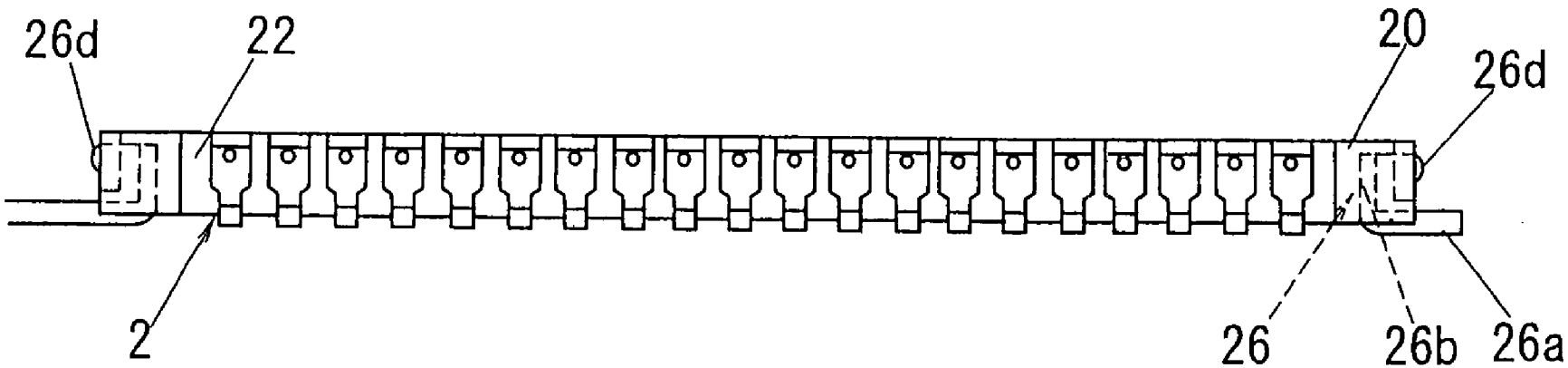
FIG. 25 is a side view of the header in the modification.

FIG. 24 shows a state of the header 2 just after the insert molding process. As can be seen from FIG. 24, the header reinforcing plates 26 are inserted along substantially the breadth of the end portions 22B of the peripheral wall 22 of the header body 20. A plurality of header reinforcing plates 26 is formed on a metal thin plate 4. A pair of metal thin plate 4 with the header reinforcing plate 26 is inserted in a molding die with blanks of the posts 21, and melted insulation resin is injected into the molding die. Thus, a plurality of headers 2 (header bodies 20) with the header reinforcing plates 26 is formed simultaneously. By cutting the header reinforcing plates 26 at bridging portions 4*a* from the metal thin plate 4, the headers 2 are separated. The header reinforcing plates 26 are cut from the metal thin plate 4 in a manner so that the rest of each bridging portion 4*a*, which serves as a fixing portion 26*a*, is protruded outwardly from the end portion 22B of the peripheral wall 22 of the header body 20. The header reinforcing plate 26 has an embedded portion 26*b* and bared portions 26*c*. The bared portions 26*c* are formed symmetrically with respect to the fixing portion 26*a* from both ends of the embedded portion 26*b*. As can be seen from FIG. 24, the embedded portion 26*b* and the bared portions 26*c* are cranked. The hooking protrusions 26*d* are respectively formed on the bared portions 26*c*.

As shown in FIG. 26, when the header 2 is coupled with the socket 1, the hooking protrusions 26*d* of the header reinforcing plate 26 are engaged with the cuttings 17*d* of the socket reinforcing plate 17, so that the coupling strength of the header 2 with the socket 1 can be assured.

In the above-mentioned embodiment, the hooking recess 17*b* and the cuttings 17*d* are provided on the socket reinforcing plate 17 and the hooking protrusions 25*g* and 26*d* are formed on the header reinforcing plate 25 and 26. It, however, is possible to form the hooking recess or cutting on the header reinforcing plate and the hooking protrusion on the socket reinforcing plate.

Figure 27:
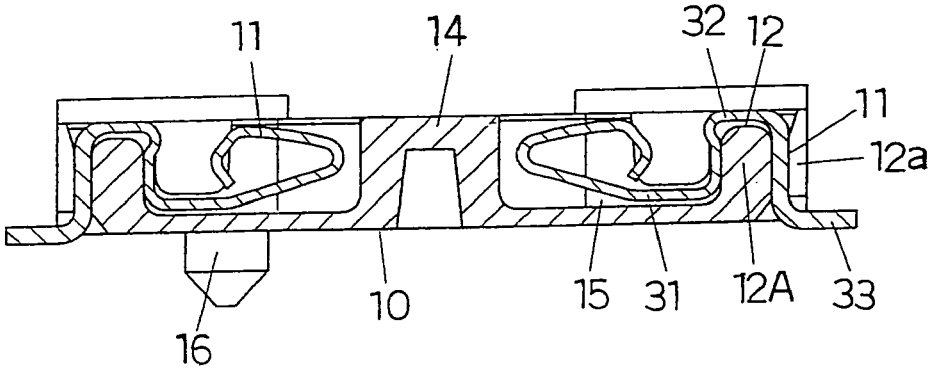
FIG. 27 is a sectional view of a socket in another modification.

Furthermore, as shown in FIG. 27, it is possible to form bottom walls in the guide grooves 14*a* of the table portion of the socket body 10. By such the bottom wall, it is possible to prevent the short circuit due to the contact 11 electrically contacts with the circuit pattern on the circuit board. In this case, the thickness of the bottom wall is about 0.01 mm.

Figure 28:
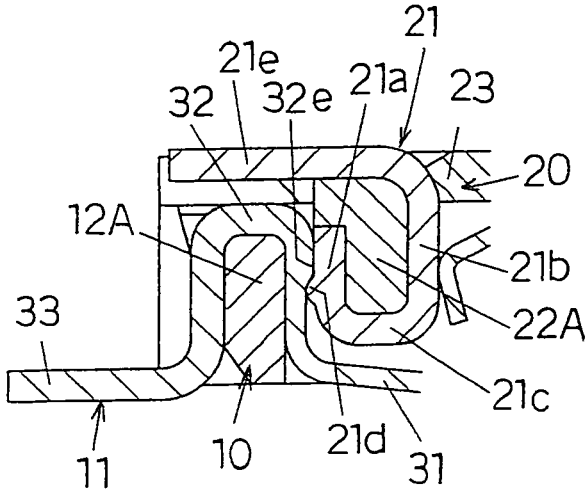
FIG. 28 is a sectional view for showing connection of a post of a header and a contact of a socket in still another modification.
Figure 29:
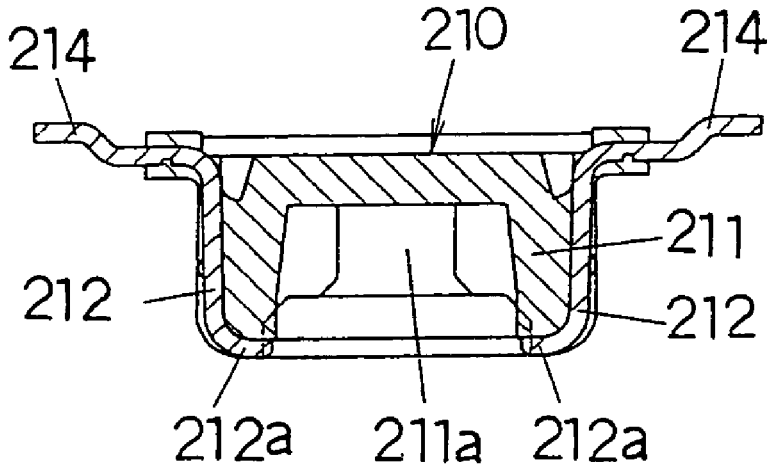
FIG. 29 (PRIOR ART)
FIG. 29 is a sectional viewing of a socket and a header of a conventional connector.
Figure 29:
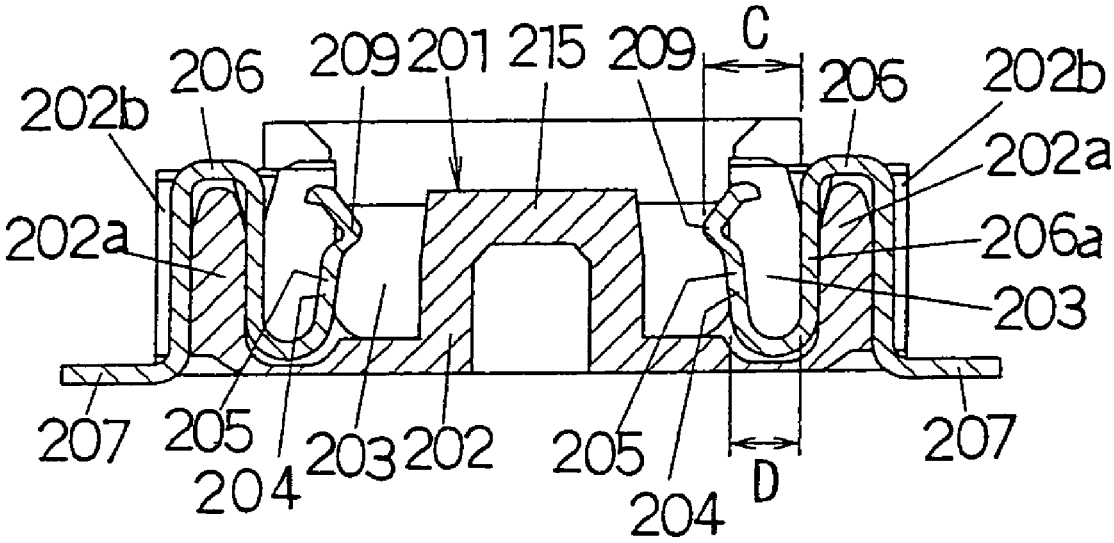
FIG. 29 (PRIOR ART)
Figure 30:
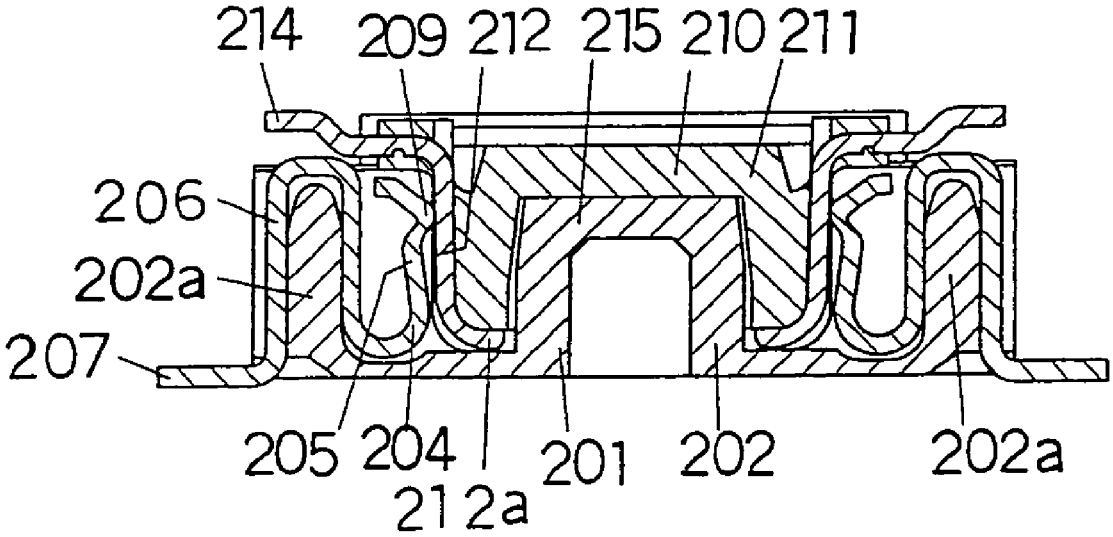
FIG. 30 (PRIOR ART)
FIG. 30 is a sectional view showing a state that the socket and the header of the conventional connector are coupled with each other.

Still furthermore, as shown in FIG. 28, the thickness of the contact 11 from the terminal portion 32 to the lower end of the second curved portion 32*e* of the fitting portion 32 can be made thick, and the protrusion 21*d* of the post 21 can be hooked with the offset portion below the second curved portion 32*e* which is formed by hammering the blank of the contact 11.

Still furthermore, the protrusion 21*d* of the post 21 and the offset below the second curved portion 32*e* of the contact 11 are not indispensable, when the predetermined contact pressure between the contact 11 and the post 21 is assured.

Still furthermore, the positioning legs 16 formed on the bottom wall 13 of the socket body 10 and the positioning legs 27 formed on the bottom wall 23 of the header body 20 are not indispensable, when the socket 1 and the header 2 can be precisely positioned on the circuit boards.

Still furthermore, the socket reinforcing plate 17 is inserted into the socket body 10 in the above-mentioned embodiment. It, however, is possible to press-fit the socket reinforcing plate 17 into the resin molded socket body 10.

This application is based on Japanese patent applications 2002-214319 and 2002-214321 filed in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

INDUSTRIAL APPLICABILITY

In the low-profile connector in accordance with the present invention, the socket reinforcing plates and the header reinforcing plates are provided in the header body and the socket body, so that the mechanical strength of the header body and the socket body can be increased, and the possibility of the occurrence of contortion or crack is decreased. Furthermore, the post of the header and the contact of the socket are contacted at two portions, so that the electric connection between the header and the socket can be maintained even when an external force for moving the header with respect to the socket is applied. Still furthermore, the length of the plate spring portion of the contact can be lengthen in comparison with that of the contact of the conventional connector. Thus, the contacting pressure acting between the contacting portion of the post of the header and the contacting portion of the contact of the socket is increased. Even when the stacking height of the connector is made lower, the reliability of the connection of the posts of the header and the contacts of the socket can be maintained.

The invention claimed is:

1. A low-profile connector comprising a header and a socket, which are respectively mounted on circuit boards for connecting at least one electric circuit formed on the circuit boards, wherein the header comprises a header body made of resin molding, and a plurality of posts provided at a predetermined pitch on a peripheral wall of the header body;

the socket comprises a socket body made of resin molding and a plurality of contacts provided at the predetermined pitch on a peripheral wall of the socket body, the contacts configured to be contacted with the posts provided on the header;

at least one of the header or the socket further comprises at least one reinforcing member provided in a portion of a peripheral wall of the header body and the socket body where the posts and the contacts are not provided; and wherein said at least one reinforcing member has a fixing portion which is configured to be soldered to one of the circuit boards, a reversed generally U-shaped bridging portion which extends over the peripheral wall, and at least one fitting protrusion which is press-fitted to the peripheral wall.

2. The connector in accordance with claim 1, wherein the at least one reinforcing member is a plurality of reinforcing members provided in the header body and/or the socket body, and at least one of the plurality of reinforcing members is inserted into the header body and/or the socket body.

3. The connector in accordance with claim 1, wherein the fixing portion protruded outwardly from the header body and/or the socket so as to be fixed on the circuit board.

4. The connector in accordance with claim 1, wherein a pair of the reinforcing members is provided in both a respective end portion of the header body and the socket body;

a part of each reinforcing member appears on a face of the header body and the socket body; and one of the reinforcing members provided in the header body and in the socket body has at least a hooking recess and the other reinforcing member provided in the socket body or in the header body has at least a hooking protrusion to be engaged with the hooking recess and formed at a position facing the hooking recess.

5. The connector in accordance with claim 4, wherein at least one of the reinforcing members provided in the header body and in the socket body can be warped in a protruding direction of the hooking protrusion when the hooking portion is engaged with the hooking recess.

6. The connector in accordance with claim 1, wherein the reinforcing member is provided along a breadth of an end portion of the header body and/or the socket body.

* * * * *

UNITED STATES PATENT AND TRADEMARK OFFICE

CERTIFICATE OF CORRECTION

PATENT NO. : 7,112,091 B2
APPLICATION NO. : 11/260634
DATED : September 26, 2006
INVENTOR(S) : Okura et al.

It is certified that error appears in the above-identified patent and that said Letters Patent is hereby corrected as shown below:

At column 16, line 31 (claim 3, line 3) of the printed patent, "socket so as" should be --socket body so as--.

Signed and Sealed this

Fifteenth Day of April, 2008

JON W. DUDAS
*Director of the United States Patent and Trademark Office*